US011248434B2

(12) United States Patent
Fraczek et al.

(10) Patent No.: US 11,248,434 B2
(45) Date of Patent: Feb. 15, 2022

(54) ROTATING CONTROL DEVICE FOR JACKUP RIGS

(71) Applicant: AMERIFORGE GROUP INC., Houston, TX (US)

(72) Inventors: Justin Fraczek, Spring, TX (US); Shawn Paul McClosky, Montgomery, TX (US); George James Michaud, Katy, TX (US); Alexander John MacGregor, Kirkcudbright (GB); Fukun Lai, Houston, TX (US)

(73) Assignee: AMERIFORGE GROUP INC., Houston, TX (US)

( * ) Notice: Subject to any disclaimer, the term of this patent is extended or adjusted under 35 U.S.C. 154(b) by 0 days.

(21) Appl. No.: 17/241,711

(22) Filed: Apr. 27, 2021

(65) Prior Publication Data

US 2021/0246754 A1 Aug. 12, 2021

Related U.S. Application Data

(63) Continuation of application No. 16/984,831, filed on Aug. 4, 2020, now Pat. No. 11,008,825, which is a (Continued)

(51) Int. Cl.
*E21B 33/08* (2006.01)
*E21B 33/068* (2006.01)
*E21B 33/06* (2006.01)

(52) U.S. Cl.
CPC ..... *E21B 33/085* (2013.01); *E21B 33/068* (2013.01); *E21B 33/06* (2013.01)

(58) Field of Classification Search
CPC ..... E21B 33/068; E21B 33/06; E21B 33/085
See application file for complete search history.

(56) References Cited

U.S. PATENT DOCUMENTS 4,815,191 A 3/1989 Garman et al.
5,823,541 A 10/1998 Dietle et al.
(Continued)

FOREIGN PATENT DOCUMENTS

WO 2011117383 A1 9/2011
WO 2019213162 A1 11/2019

OTHER PUBLICATIONS

U.S. Appl. No. 62/665,885, filed May 2, 2018, Justin Fraczek.
(Continued)

*Primary Examiner* — Aaron L Lembo
(74) *Attorney, Agent, or Firm* — Basil M. Angelo; Angelo IP

(57) ABSTRACT

A rotating control device includes a bowl housing with an inner aperture to receive a seal and bearing assembly. A plurality of hydraulically-actuated fail-last-position latching assemblies are disposed about an outer surface of the bowl housing to controllably extend a plurality of piston-driven dogs radially into a groove of the seal and bearing assembly. The seal and bearing assembly includes a housing, a mandrel disposed within an inner aperture of the housing, a first interference-fit sealing element attached to a bottom distal end of the mandrel, a plurality of tapered-thrust bearings indirectly mounted to the housing, a preload spacer disposed between top and bottom tapered-thrust bearings, a plurality of jam nuts to adjust a preload of the tapered-thrust bearings, and a lower seal carrier attached to the seal and bearing housing comprising a plurality of dynamic sealing elements that contact the mandrel.

20 Claims, 32 Drawing Sheets

Related U.S. Application Data continuation of application No. PCT/US2019/030016, filed on Apr. 30, 2019.

(60) Provisional application No. 62/665,879, filed on May 2, 2018.

(56) References Cited

U.S. PATENT DOCUMENTS

| | | | |
|---|---|---|---|
| 8,844,652 | B2 | 9/2014 | Sokol et al. |
| 10,995,573 | B2 | 8/2021 | Fraczek |
| 2001/0047885 | A1 | 12/2001 | Calder |
| 2002/0070014 | A1 | 6/2002 | Kinder |
| 2009/0057024 | A1 | 3/2009 | Williams |
| 2016/0305213 | A1 | 10/2016 | Godfrey et al. |
| 2017/0051785 | A1 | 2/2017 | Cooper |

OTHER PUBLICATIONS

Applicant reply to Office Action dated Dec. 23, 2020, in U.S. Appl. No. 16/984,831, filed Aug. 4, 2020, reply submitted dated Jan. 11, 2021.

Applicant reply to Office Action dated Sep. 22, 2020, in U.S. Appl. No. 16/984,874, filed Aug. 4, 2020, reply submitted dated Dec. 21, 2020.

Applicant reply to Restriction Requirement dated Oct. 9, 2020, in U.S. Appl. No. 16/984,831, filed Aug. 4, 2020, reply submitted dated Dec. 7, 2020.

PCT international search report of international search authority (USPTO) in PCT international application PCT/US2019/030016, filed Apr. 30, 2019, dated Aug. 9, 2019.

PCT international search report of international search authority (USPTO) in PCT international application PCT/US2019/030042, filed Apr. 30, 2019, dated Jul. 17, 2019.

PCT written opinion of international search authority (USPTO) in PCT international application PCT/US2019/030016, filed Apr. 30, 2019, dated Aug. 9, 2019.

PCT written opinion of international search authority (USPTO) in PCT international application PCT/US2019/030042, filed Apr. 30, 2019, dated Jul. 17, 2019.

USPTO non-final office action issued in U.S. Appl. No. 16/984,831, filed Aug. 4, 2020, dated Dec. 23, 2020.

USPTO non-final office action issued in U.S. Pat. App. Ser. No. 2009/0057024, dated Sep. 22, 2020.

USPTO notice of allowance issued in U.S. Appl. No. 16/984,831, filed Aug. 4, 2020, dated Feb. 3, 2021.

USPTO notice of allowance issued in U.S. Appl. No. 16/984,874, filed Aug. 4, 2020, dated Jan. 8, 2021.

USPTO restriction requirement issued in U.S. Appl. No. 16/984,831, filed Aug. 4, 2020, dated Oct. 9, 2020.

FIG. 6A
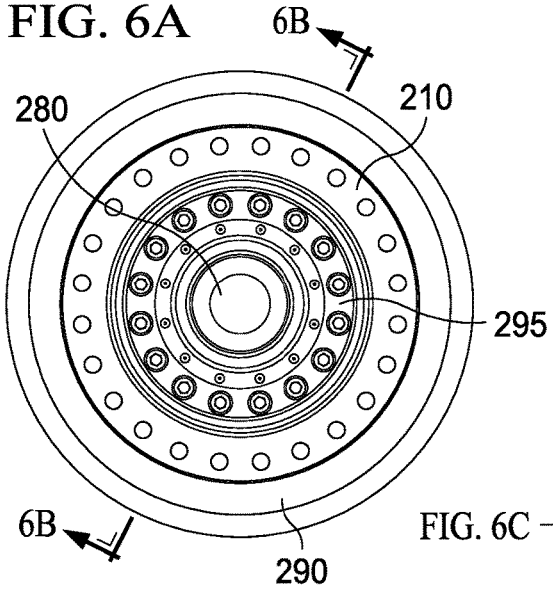
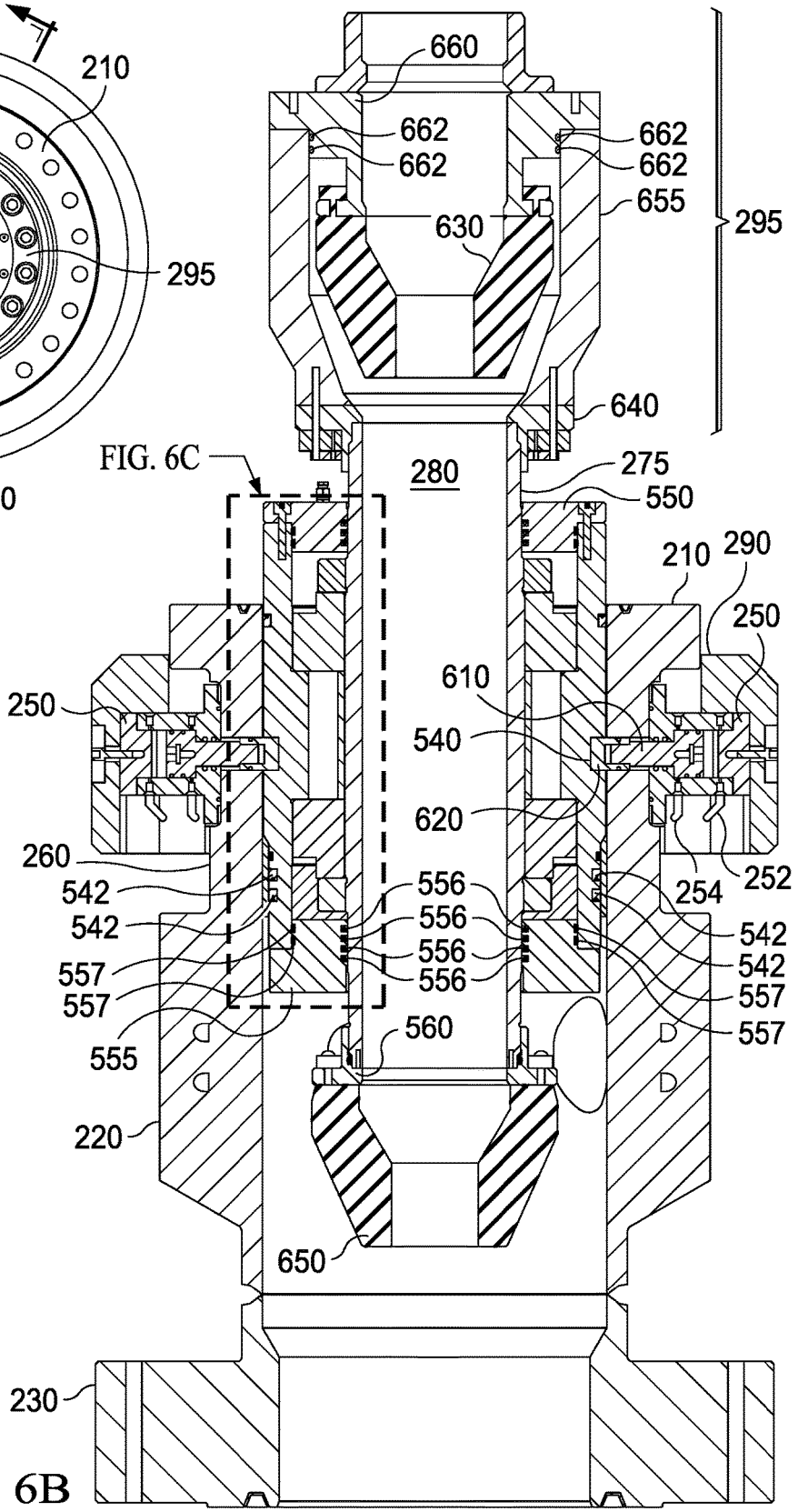
FIG. 6B

ROTATING CONTROL DEVICE FOR JACKUP RIGS

CROSS-REFERENCE TO RELATED APPLICATIONS

This application is a continuation of U.S. patent application Ser. No. 16,984,831, filed on Aug. 4, 2020, which is a continuation of PCT International Application PCT/US2019/030016, filed on Apr. 30, 2019, which claims the benefit of, or priority to, U.S. Provisional Patent Application Ser. No. 62/665,879, filed on May 2, 2018, all of which are hereby incorporated by reference in their entirety for all purposes.

BACKGROUND OF THE INVENTION

A jackup rig is a type of mobile offshore drilling unit that is used to drill in relatively shallow waters. Jackup rigs are bottom-supported by open-truss or columnar legs that are stationed on the ocean floor and used to raise or lower the primary platform based on wind and water conditions. In conventional drilling operations, a wellhead is disposed on the ocean floor over a wellbore, a marine riser fluidly connects the wellhead to a blowout preventer, and the blowout preventer fluidly connects to a rotating control device used together with other pressure control equipment to manage wellbore pressure. An overshot pipe, or bell nipple, typically connects the rotating control device to a flow diverter at or near the platform level. The overshot pipe is adjusted to accommodate the height difference between the rotating control device and the primary platform as it is raised or lowered. During drilling operations, the drill string extends through an interior passageway of the rotating control device, blowout preventer, marine riser, and wellhead and extends into the wellbore, which may extend many thousands of feet below the Earth's surface.

In applications where wellbore pressure is managed, including, for example, managed pressure drilling, pressurized mud cap drilling, underbalanced drilling, extended reach wells, and other drilling operations, the annulus surrounding the drill string is sealed by the rotating control device and the wellbore pressure is managed by a surface-backpressure choke manifold disposed on the drilling platform. Specifically, wellbore pressure is managed by controlling one or more chokes of the surface-backpressure choke manifold fed by one or more fluid flow lines that divert returning fluid flow from the rotating control device to the surface. Each choke valve of the surface-backpressure choke manifold is capable of a fully opened state where flow is unimpeded, a fully closed state where flow is stopped, and intermediate states where the valve is partially opened or closed, thereby restricting flow and applying surface backpressure commensurate with the flow restriction. If the driller wishes to increase annular pressure, one or more chokes may be closed to the extent necessary to increase the annular pressure the desired amount. Similarly, if the driller wishes to reduce annular pressure, one or more chokes may be opened to the extent necessary to decrease the annular pressure the desired amount. In this way, wellbore pressure may be managed by controlling the surface backpressure from the platform of the drilling rig.

BRIEF SUMMARY OF THE INVENTION

According to one aspect of one or more embodiments of the present invention, a rotating control device includes a bowl housing having a plurality of fluid flow ports and an inner aperture to receive a removable seal and bearing assembly, a plurality of hydraulically-actuated fail-last-position latching assemblies disposed about an outer surface of the bowl housing having a plurality of piston-driven dogs to controllably extend the plurality of piston-driven dogs radially into a groove of the seal and bearing assembly to controllably secure the seal and bearing assembly to the bowl housing, and the seal and bearing assembly having a seal and bearing housing, a mandrel disposed within an inner aperture of the seal and bearing housing, a first interference-fit sealing element attached to a bottom distal end of the mandrel, a plurality of tapered-thrust bearings indirectly mounted to the seal and bearing housing to facilitate rotation of the mandrel, a preload spacer disposed between top and bottom tapered-thrust bearings, a plurality of jam nuts to adjust a preload of the tapered-thrust bearings, and a lower seal carrier attached to the seal and bearing housing having a plurality of dynamic sealing elements that contact the mandrel while it rotates and a plurality of static sealing elements that contact the seal and bearing housing.

According to one aspect of one or more embodiments of the present invention, a seal and bearing assembly including a seal and bearing housing having a groove to receive a plurality of hydraulically-actuated fail-last-position piston-driven dogs, a mandrel having a mandrel lumen disposed within an inner aperture of the seal and bearing housing, a first interference-fit sealing element attached to a bottom distal end of the mandrel, a plurality of tapered-thrust bearings indirectly mounted to the seal and bearing housing to facilitate rotation of the mandrel, a preload spacer disposed between top and bottom tapered-thrust bearings, a plurality of jam nuts to adjust a preload of the tapered-thrust bearings, and a lower seal carrier attached to the seal and bearing housing comprising a plurality of dynamic sealing elements that contact the mandrel while it rotates and a plurality of static sealing elements that contact the seal and bearing housing.

Other aspects of the present invention will be apparent from the following description and claims.

BRIEF DESCRIPTION OF THE DRAWINGS

FIG. 6A shows a top plan view of an improved rotating control device with shroud that includes an intra-overshot-pipe assembly in accordance with one or more embodiments of the present invention.

FIG. 6B shows a longitudinal cross section of the improved rotating control device with shroud that includes the intra-overshot-pipe assembly showing engagement of the plurality of hydraulically-actuated piston-driven dogs in accordance with one or more embodiments of the present invention.

DETAILED DESCRIPTION OF THE INVENTION

Figure 1:
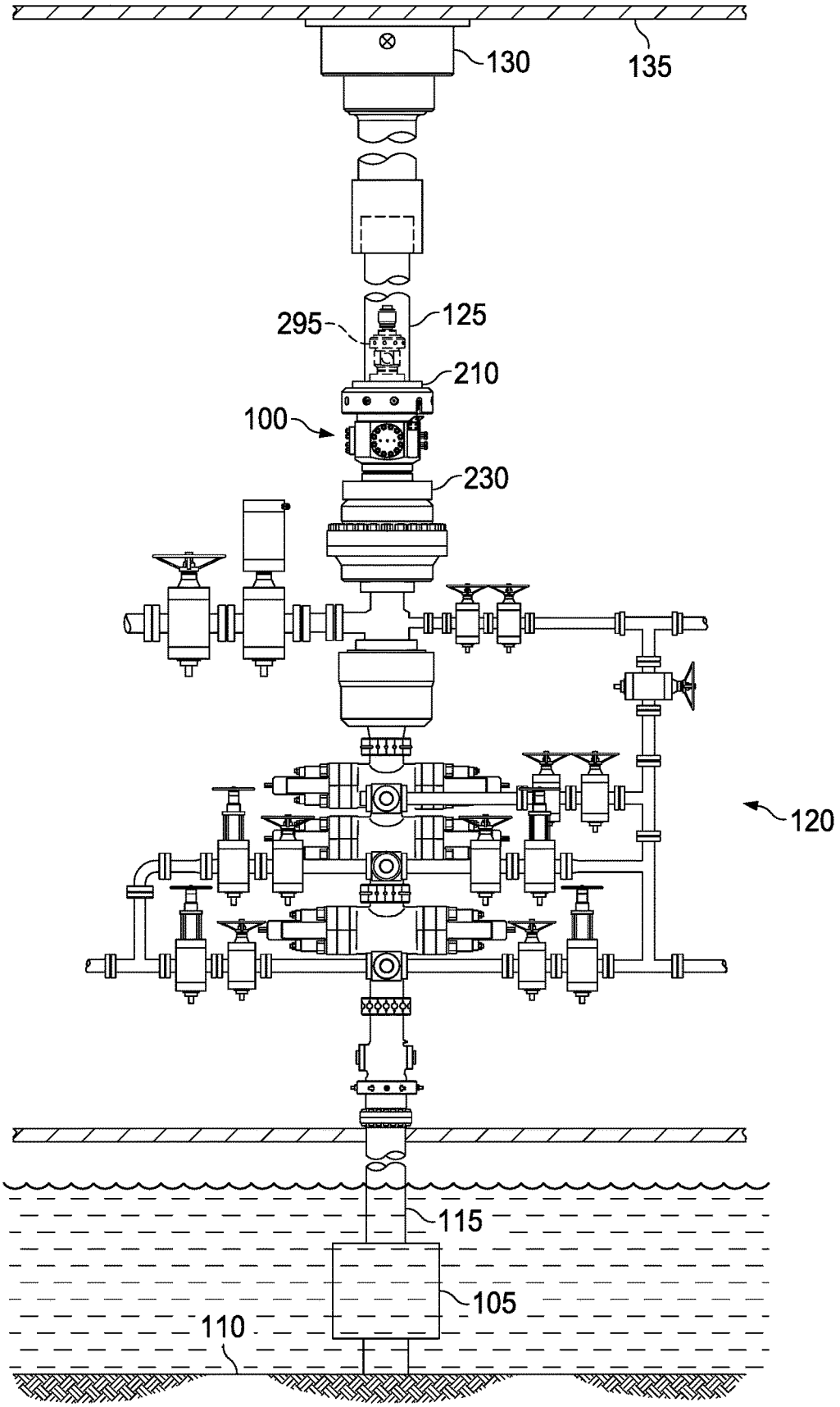
FIG. 1 shows an upper marine riser package for a jackup rig that includes an improved rotating control device in accordance with one or more embodiments of the present invention.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are not described to avoid obscuring the description of the present invention.

In applications where wellbore pressure is managed, an annular closing, or pressure containment, device is used to seal the annulus surrounding the drill string. Pressure containment devices include rotating control devices, non-rotating control devices, and other annular closing devices. Rotating control devices typically include one or more sealing elements that rotate with the drill string, whereas non-rotating control devices typically include one or more sealing elements that do not rotate with the drill string. The one or more sealing elements are either active or passive. Active sealing elements typically use active seals such as, for example, hydraulically actuated sealing elements, whereas passive sealing elements typically use passive seals. Rotating control devices using passive sealing elements are the most commonly used type of pressure containment device in use today due to their comparatively lower upfront costs and proven track record of success in the field.

However, conventional rotating control devices suffer from a number of issues that complicate their use, reduce their productive uptime, and increase the total cost of ownership. Conventional rotating control devices include one or more sealing elements that perform the sealing function and one or more bearing assemblies that facilitate rotation of the sealing elements with the drill string. The bearing assemblies are prone to failure due to, for example, mechanical wear out, lack of lubrication, reciprocation on the drill pipe, and the like, requiring their removal and replacement, resulting in expensive non-productive downtime. In some circumstances, the drill string must be tripped out to remove and replace the bearing assembly of the rotating control device at substantial expense. As such, a significant contributor to the total cost of ownership of conventional rotating control devices is the cost associated with installing, monitoring, servicing, removing, and replacing the bearing assembly and the related non-productive downtime. In addition, conventional rotating control devices typically use mechanical clamping mechanisms to secure the seal and bearing assembly to a housing. The clamping mechanisms are prone to mechanical wear out and damage from rig operations and reciprocation of the drill string and, when they fail, control of wellbore pressure is lost, posing a significant danger to the safety of rig personnel and increasing the risk of fouling the environment.

Accordingly, in one or more embodiments of the present invention, an improved rotating control device for jackup rigs has a simplified design that includes fewer parts, costs less to manufacture, and reduces upfront costs as well as total cost of ownership over the lifetime of use. The improved rotating control device includes a plurality of clamp-less, hydraulically-actuated, and fail-last-position latching assemblies that controllably extend a plurality of piston-driven dogs radially into a groove of a seal and bearing assembly. Advantageously, the seal and bearing assembly can be easily and more quickly installed, removed, and replaced with a substantial reduction in the non-productive time typically associated with such tasks. If hydraulic power is lost, the latching assemblies fail in their last position, ensuring that the seal and bearing assembly remains stable within the rotating control device. In addition, the seal and bearing assembly includes a plurality of indirectly mounted tapered-thrust bearings that increase radial stability that reduces or eliminates wear out caused by reciprocation of the drill string, thereby extending the productive life of the seal and bearing assembly. Advantageously, a unique seal carrier design provides highly accurate bearing preload that further extends the productive life of the seal and bearing assembly without the use of springs or shims. In addition, the unique seal carrier design includes discrete and removable seal carrier trays that facilitate the efficient removal and replacement of seals without damaging the seal carrier housing. Other advantageous aspects of one or more embodiments of the present invention will be readily apparent to one of ordinary skill in the art based on the following disclosure.

FIG. 1 shows an upper marine riser package for a jackup rig (not independently illustrated) that includes an improved rotating control device 100 in accordance with one or more embodiments of the present invention. A wellhead 105 may be disposed over a wellbore (not independently illustrated) that is drilled into the subsea surface 110. A marine riser 115, which may be several hundred feet or more in length, may fluidly connect wellhead 105 to the upper marine riser package of the jackup rig (not independently illustrated). The upper marine riser package may include an annular blowout preventer 120 that is fluidly connected to rotating control device 100. Rotating control device 100 may be connected to overshot pipe 125, which is in fluid communication with a flow diverter 130 that meets platform 135 of the jackup rig (not independently illustrated). As shown in the figure, an intra-overshot-pipe assembly 295 of rotating control device 100 may be disposed and rotate within overshot pipe 125. Overshot pipe 125 may be adjusted to accommodate the height difference between platform 135 and the upper marine riser package as the height of the jackup rig (not independently illustrated) is adjusted based on wind and water conditions. Advantageously, the disposition of the intra-overshot-pipe assembly 295 within the overshot pipe 125 allows the jackup rig to be lowered more than would otherwise be possible if the assembly 295 was housed outside of pipe 125. Overshot pipe 125 may connect to a top flange 210 of rotating control device 100 and a bottom flange 230 of rotating control device 100 may connect to the annular blowout preventer 120 disposed below rotating control device 100 in the upper marine riser stackup.

A drill string (not shown) may be disposed through a common lumen that extends from platform 135 through overshot pipe 125, rotating control device 100, blowout preventer 120, marine riser 115, wellhead 105, and into the wellbore (not independently illustrated). As used herein, lumen means an interior passageway of a tubular or structure that may vary in diameter along the passageway. Drilling fluids (not shown) may be pumped downhole through an interior passageway of the drill string (not shown). Rotating control device 100 may include at least one sealing element (not shown), and in some applications, two or more sealing elements (not shown) that seal the annulus (not shown) that surrounds the drill string (not shown). A fluid flow line (not shown) may divert returning annular fluids from a fluid flow port of the rotating control device 100 to platform 135 for recycling and reuse. The annular pressure may be managed from the surface by manipulating a surface-backpressure choke manifold (not shown) disposed on platform 135.

Figure 2A:
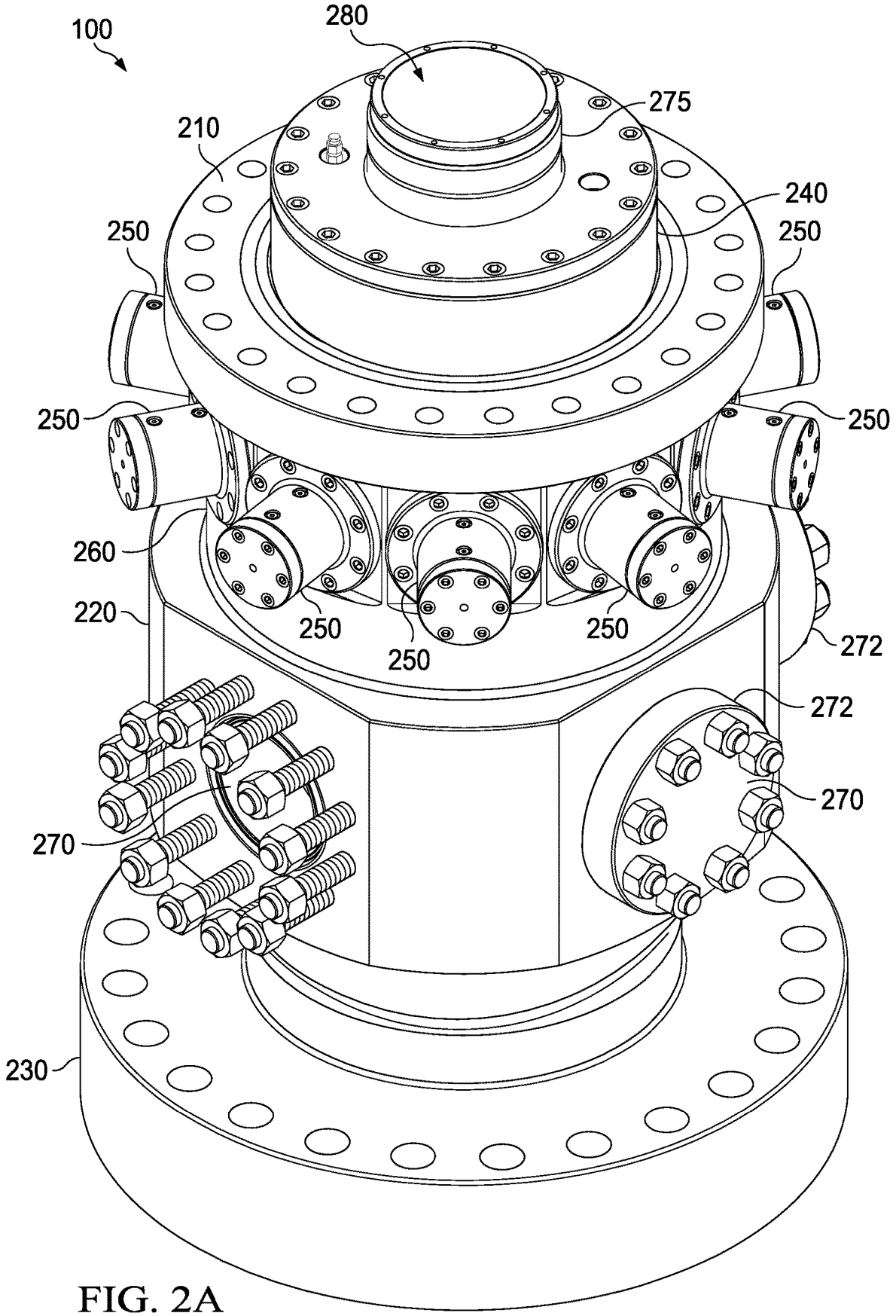
FIG. 2A shows a perspective view of an improved rotating control device without shroud in accordance with one or more embodiments of the present invention.

FIG. 2A shows a perspective view of an improved rotating control device 100 without a shroud in accordance with one or more embodiments of the present invention. Rotating control device 100 may include a top flange 210, a bowl housing 220, a bottom flange 230, and a plurality of hydraulically-actuated fail-last-position latching assemblies 250.

Top flange 210 may include a top flange lumen that extends centrally therethrough and may be attached to a top distal end of bowl housing 220. Top flange 210 may be used to connect rotating control device 100 to an overshot pipe (not shown) or bell nipple (not shown) disposed above rotating control device 100 in the riser stack. Bottom flange 230 may include a bottom flange lumen that extends centrally therethrough and may be attached to a bottom distal end of bowl housing 220. Bottom flange 230 may be used to connect rotating control device 100 to an annular (not shown) or blowout preventer (not shown) disposed below rotating control device 100 in the riser stack.

Bowl housing 220 may include an inner aperture to receive a removably disposed seal and bearing assembly (e.g., 500 of FIG. 5) and a plurality of fluid flow ports 270. A first interference-fit sealing element (not shown) may be attached to a bottom distal end of mandrel 275 and provide an interference-fit with a drill pipe (not shown) disposed therethrough and a cavity (not shown) surrounding the first interference-fit sealing element (not shown) where fluids may be directed to or from fluid flow ports 270. In one or more embodiments of the present invention, one or more of fluid flow ports 270 may be a flow diversion port, an injection port, or a surface-backpressure management port. One of ordinary skill in the art will recognize that the number, size, and configuration of fluid flow ports 270 may vary based on an application or design in accordance with one or more embodiments of the present invention.

A plurality of hydraulically-actuated fail-last-position latching assemblies 250 may be disposed about an outer surface of a recessed area 260 of bowl housing 220. The plurality of hydraulically-actuated fail-last-position latching assemblies 250 may be clamp-less and hydraulically powered to controllably extend a plurality of piston-driven dogs (not shown) radially into a groove (not shown) of seal and bearing assembly 500. In this way, the latching assemblies 250 may be used to controllably secure seal and bearing assembly 500 to bowl housing 220 in a manner that allows for the quick and easy installation, service, removal, and replacement of assembly 500. Because of the design of the piston-driven dogs (not shown) of latching assemblies 250 and the mating groove (not shown) of seal and bearing housing 240, in the event hydraulic power is lost, latching assemblies 250 maintain their last position, thus they are said to fail in their last position, thereby improving the safety of rotating control device 100 and operations in progress. As such, hydraulic power is required to activate the piston-driven dog, but not to maintain its position. Hydraulic power is then required again to deactivate the piston-drive dog. In the embodiment depicted, ten (10) hydraulically-actuated fail-last-position latching assemblies 250 are distributed about the outer surface of the recessed area 260 of bowl housing 220. One of ordinary skill in the art will recognize that the number of latching assemblies 250 required to controllably secure the seal and bearing assembly (e.g., 500 of FIG. 5), and their distribution about the outer surface, may vary based on an application or design in accordance with one or more embodiments of the present invention. Further, one of ordinary skill in the art will also recognize that the number of latching assemblies 250 required to controllably secure the seal and bearing assembly (e.g., 500 of FIG. 5) may vary with the dimensions of rotating control device 100, the seal and bearing assembly (e.g., 500 of FIG. 5), the piston-driven dogs (not shown), and the mating groove (not shown) of seal and bearing housing 240 in accordance with one or more embodiments of the present invention.

Figure 2B:
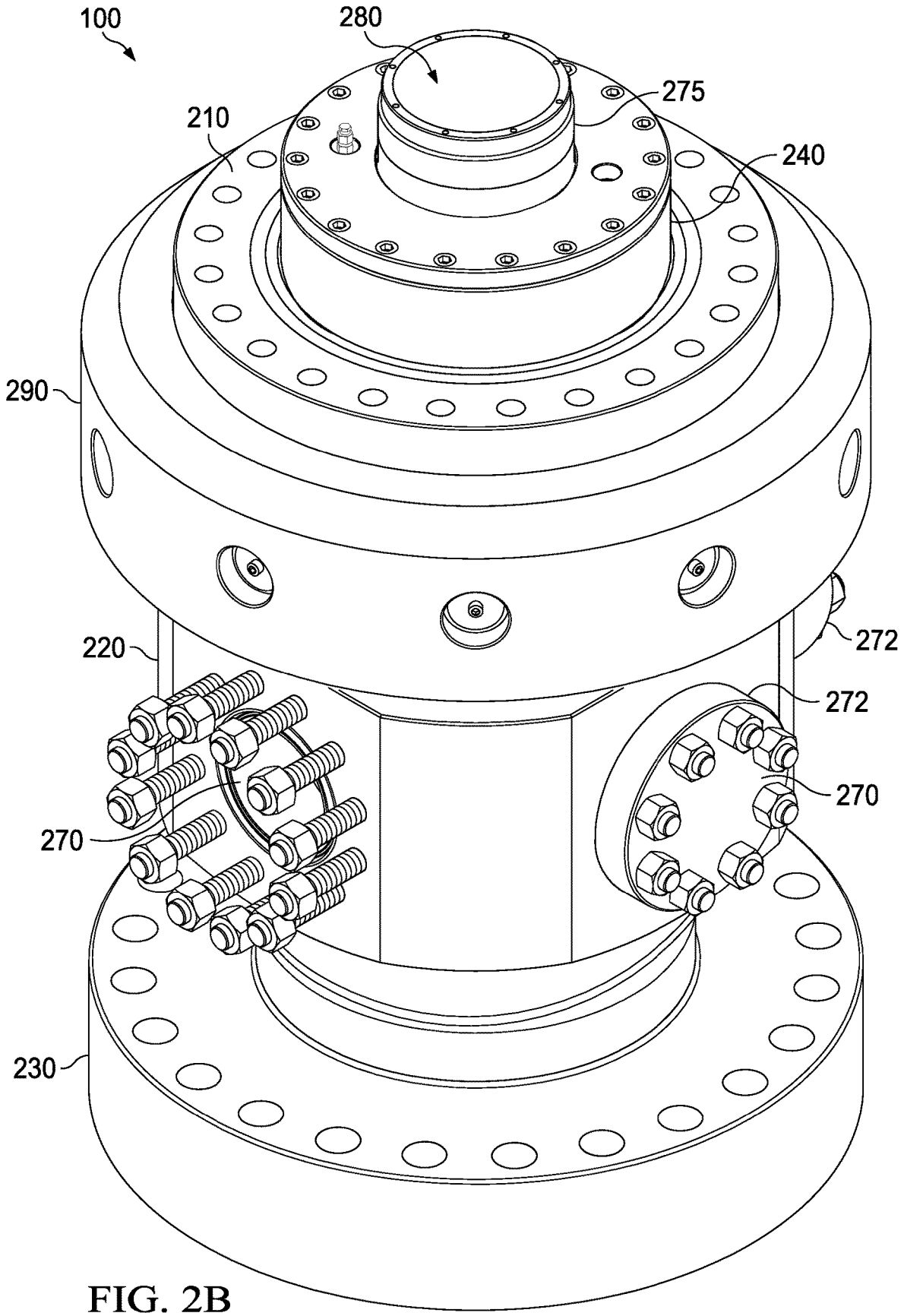
FIG. 2B shows a perspective view of the improved rotating control device with shroud in accordance with one or more embodiments of the present invention.

Continuing, FIG. 2B shows a perspective view of the improved rotating control device 100 with shroud 290 in accordance with one or more embodiments of the present invention. A protective shroud 290 may be disposed around the plurality of hydraulically-actuated fail-last-position latching assemblies 250 that are distributed about the outer surface of the recessed area 260 of bowl housing 220. The shroud 290 may protect the protruding portions of the hydraulically-actuated fail-last-position latching assemblies 250 during installation, operation, service, and removal.

Figure 2C:
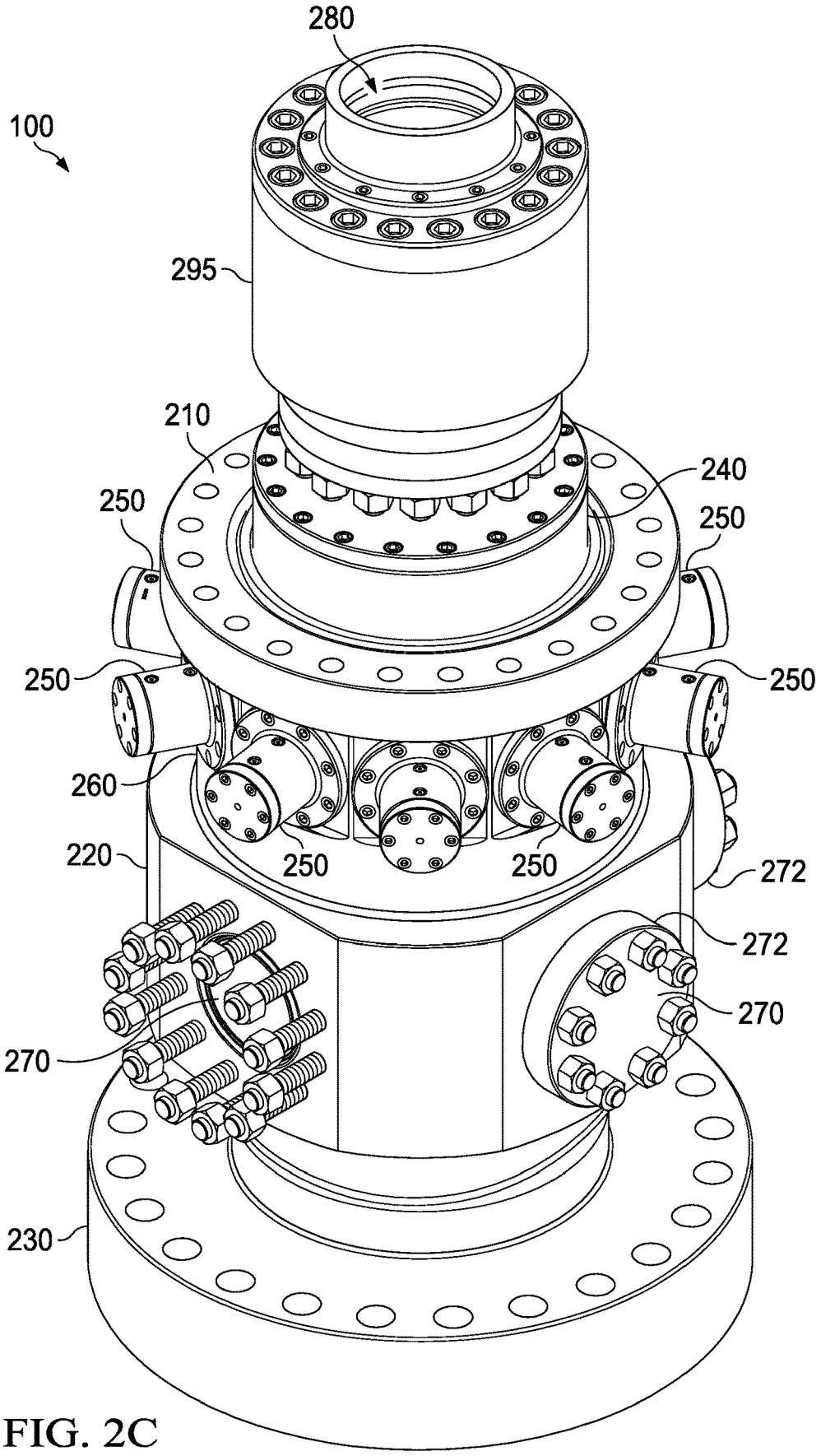
FIG. 2C shows a perspective view of the improved rotating control device without shroud that includes an intra-overshot-pipe assembly in accordance with one or more embodiments of the present invention.

Continuing, FIG. 2C shows a perspective view of the improved rotating control device without shroud that includes an intra-overshot-pipe assembly 295 in accordance with one or more embodiments of the present invention. In offshore applications, or as needed, a second interference-fit sealing element (not shown) may be used to provide redundant sealing of the annulus (not shown) surrounding the drill pipe (not shown). An intra-overshot-pipe assembly 295 may be removably attached to a top distal end of a mandrel (not shown, e.g., 275) of seal and bearing assembly (e.g., 500 of FIG. 5). Intra-overshot-pipe assembly 295 may include a second interference-fit sealing element (not shown). Advantageously, the design of the improved rotating control device 100 allows for the optional inclusion or removal of the second interference-fit sealing element (not shown) based on the application or design of the rig.

Figure 2D:
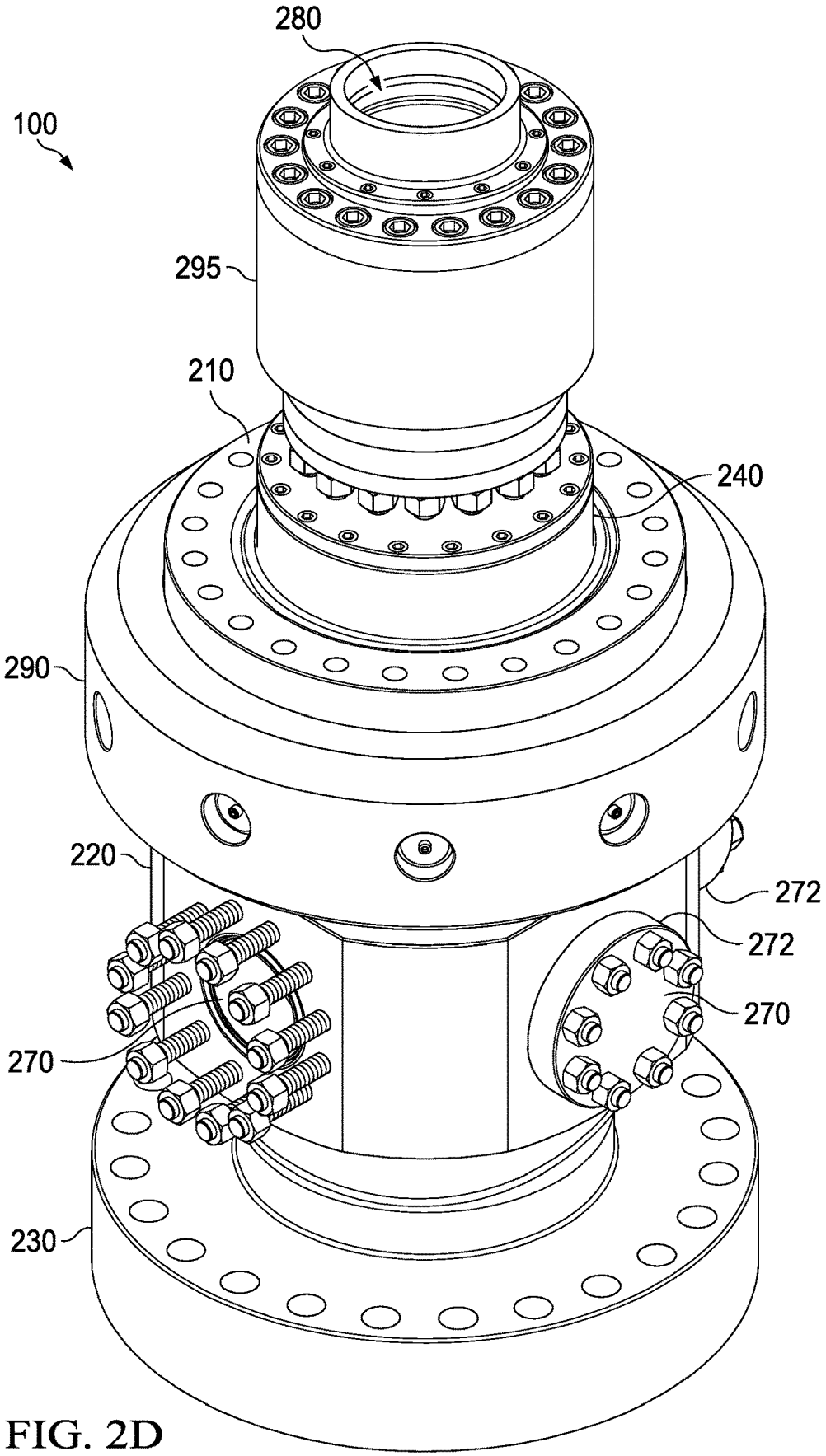
FIG. 2D shows a perspective view of the improved rotating control device with shroud that includes the intra-overshot-pipe assembly in accordance with one or more embodiments of the present invention.

Continuing, FIG. 2D shows a perspective view of the improved rotating control device 100 with shroud 290 that includes the intra-overshot-pipe assembly 295 in accordance with one or more embodiments of the present invention. In operation, intra-overshot-pipe assembly 295 may be disposed and rotate within an overshot pipe (not shown) disposed above rotating control device 100. Because the intra-overshot-pipe assembly 295 may be disposed within an overshot pipe (not shown) the jackup rig (not shown) may advantageously be lowered more than it otherwise would be able to.

Figure 3A:
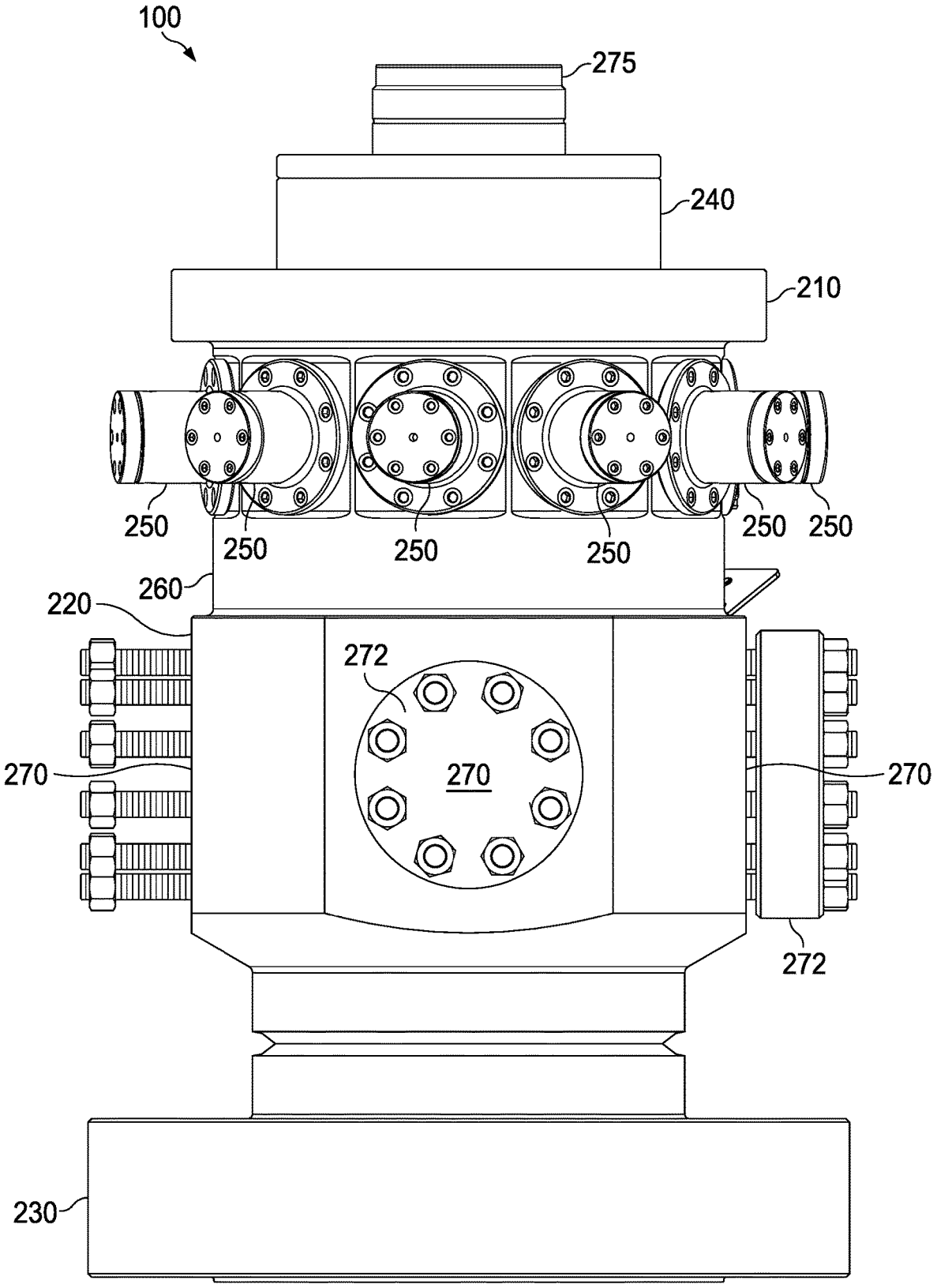
FIG. 3A shows a front elevation view of an improved rotating control device without shroud in accordance with one or more embodiments of the present invention.
Figure 3B:
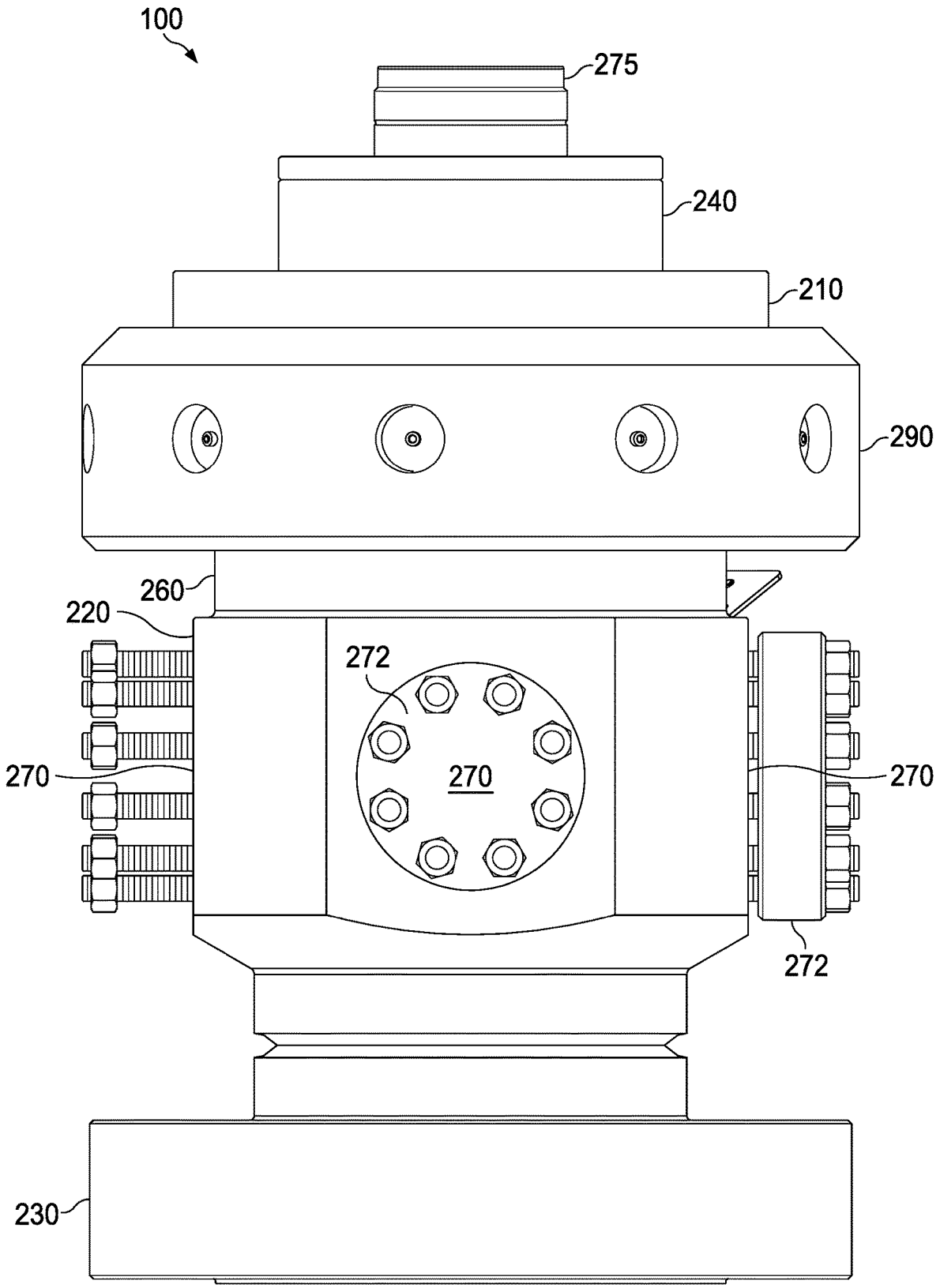
FIG. 3B shows a front elevation view of the improved rotating control device with shroud in accordance with one or more embodiments of the present invention.

FIG. 3A shows a front elevation view of an improved rotating control device 100 without shroud in accordance with one or more embodiments of the present invention. A plurality of hydraulically-actuated fail-last-position latching assemblies 250 may be disposed about an outer surface of a recessed portion 260 of bowl housing 220. Each latching assembly 250 may be oriented such that a piston-driven dog (not shown) may be radially deployed through an opening (not shown) of bowl housing 220 and into a mating groove (not shown) of seal and bearing housing 240 to controllably secure seal and bearing assembly (e.g., 500 of FIG. 5) to bowl housing 220. Continuing, FIG. 3B shows a front elevation view of the improved rotating control device 100 with shroud 290 in accordance with one or more embodiments of the present invention. Protective shroud 290 may protect the protruding portions of the hydraulically-actuated fail-last-position latching assemblies 250.

Figure 3C:
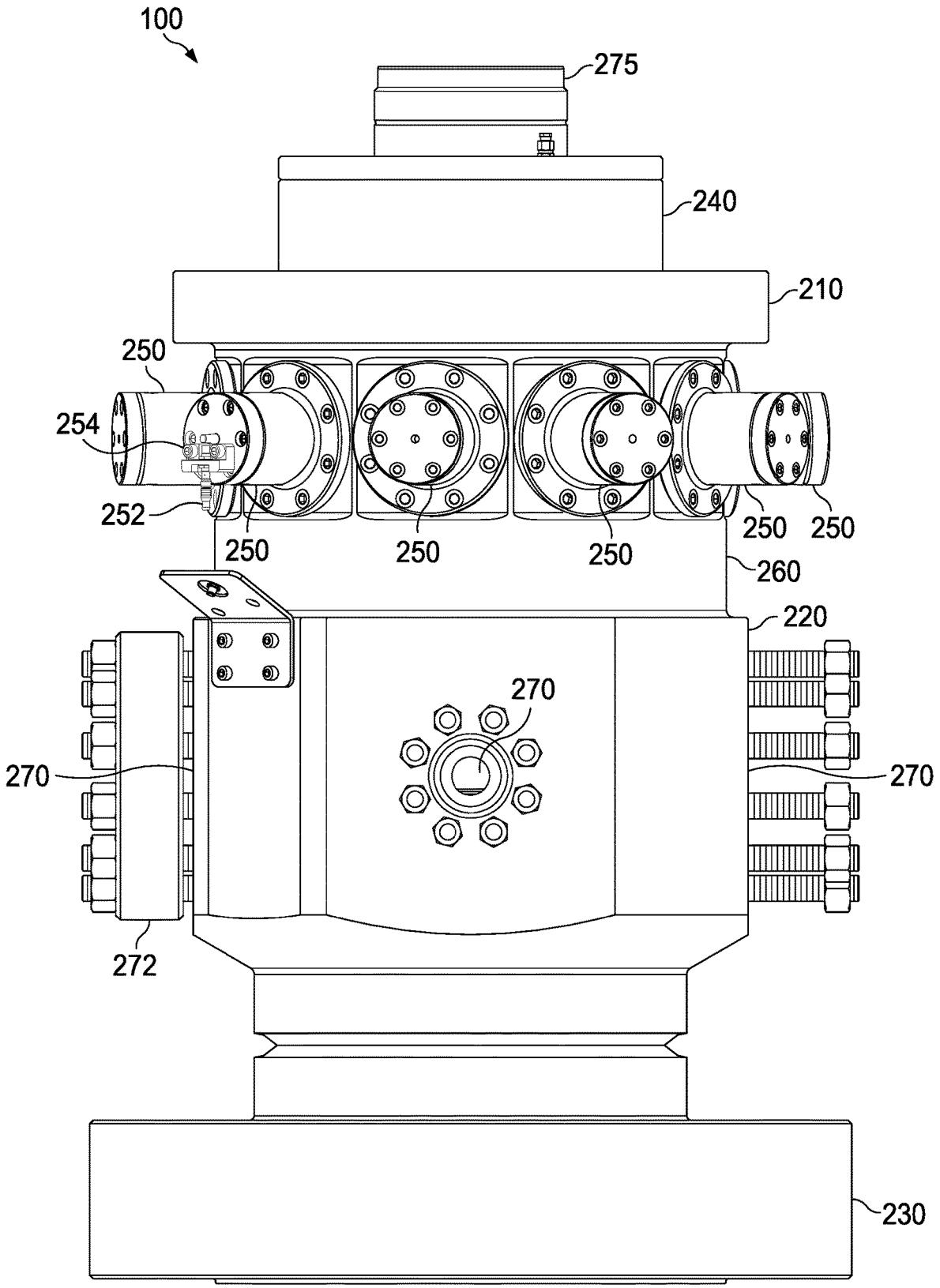
FIG. 3C shows a rear elevation view of the improved rotating control device without shroud in accordance with one or more embodiments of the present invention.
Figure 3D:
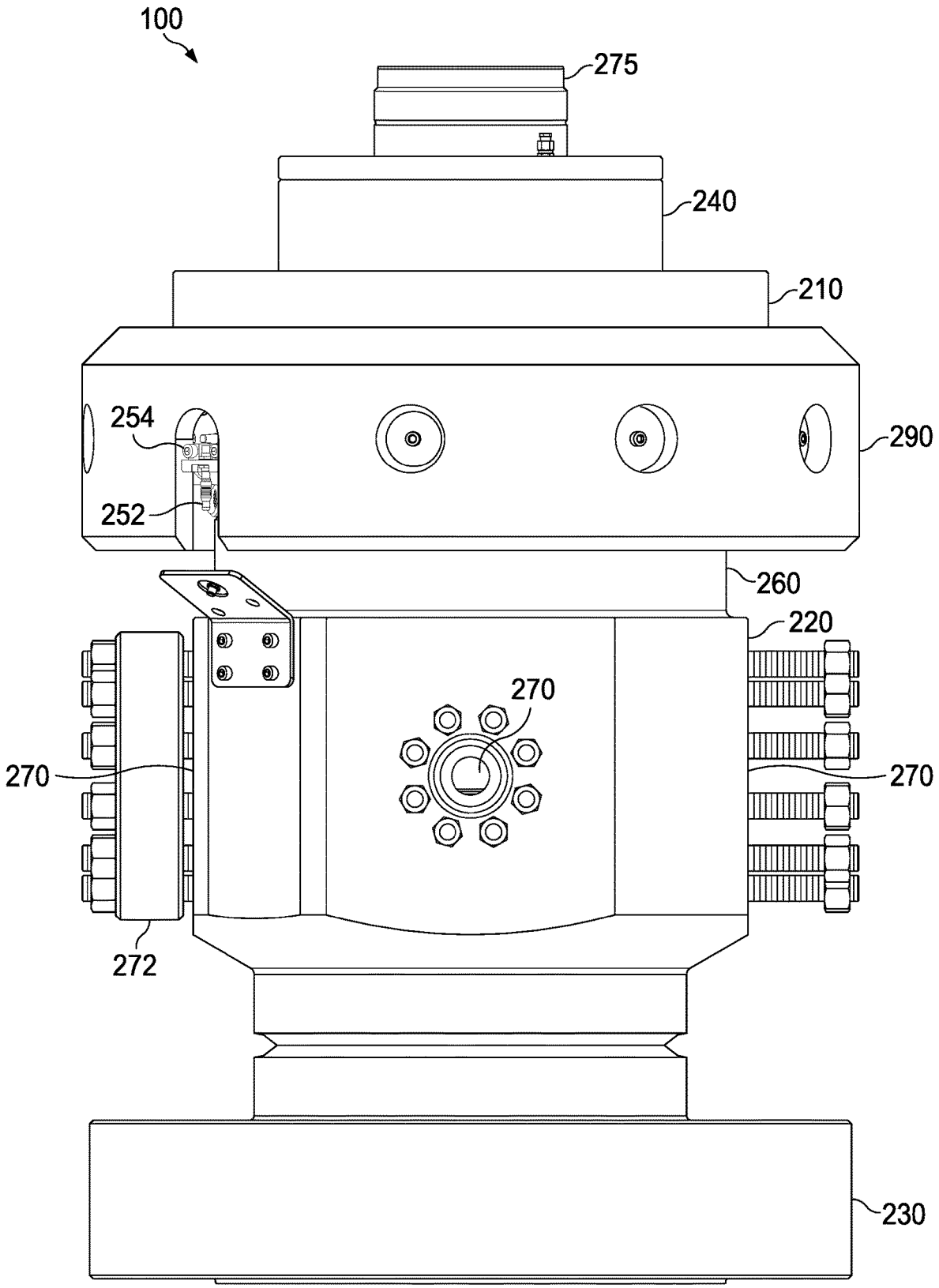
FIG. 3D shows a rear elevation view of the improved rotating control device with shroud in accordance with one or more embodiments of the present invention.

Continuing, FIG. 3C shows a rear elevation view of the improved rotating control device 100 without shroud in accordance with one or more embodiments of the present invention. The plurality of hydraulically-actuated fail-last-position latching assemblies 250 may include one or more hydraulic ports 252 and 254 that may be used to hydraulically deploy or retract their piston-driven dogs (not shown). The hydraulic fluid lines (not shown) may be daisy-chained such that the plurality of latching assemblies 250 deploy or retrain their piston-driven dogs (not shown) at substantially the same time. Continuing, FIG. 3D shows a rear elevation view of the improved rotating control device 100 with shroud 290 in accordance with one or more embodiments of the present invention. Protective shroud 290 may include a cutout where one or more hydraulic ports 252 and 254 may be connected to a latching assembly 250. The remaining latching assemblies 250 may receive hydraulic power from a daisy-chain of hydraulic fluid lines (not shown) emanating from hydraulic ports 252 and 254 that are disposed below shroud 290.

Figure 3E:
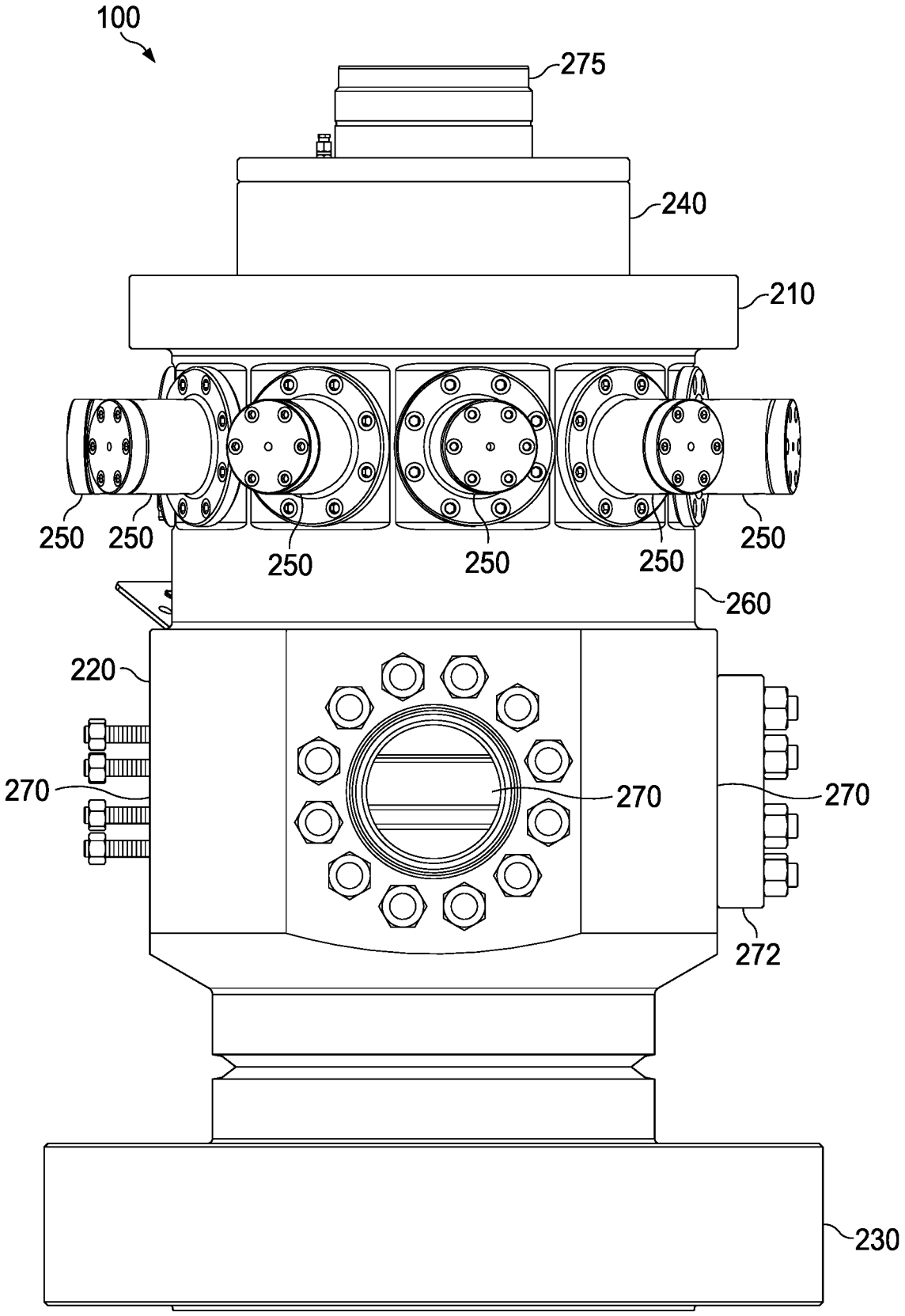
FIG. 3E shows a left-side elevation view of the improved rotating control device without shroud in accordance with one or more embodiments of the present invention.
Figure 3F:
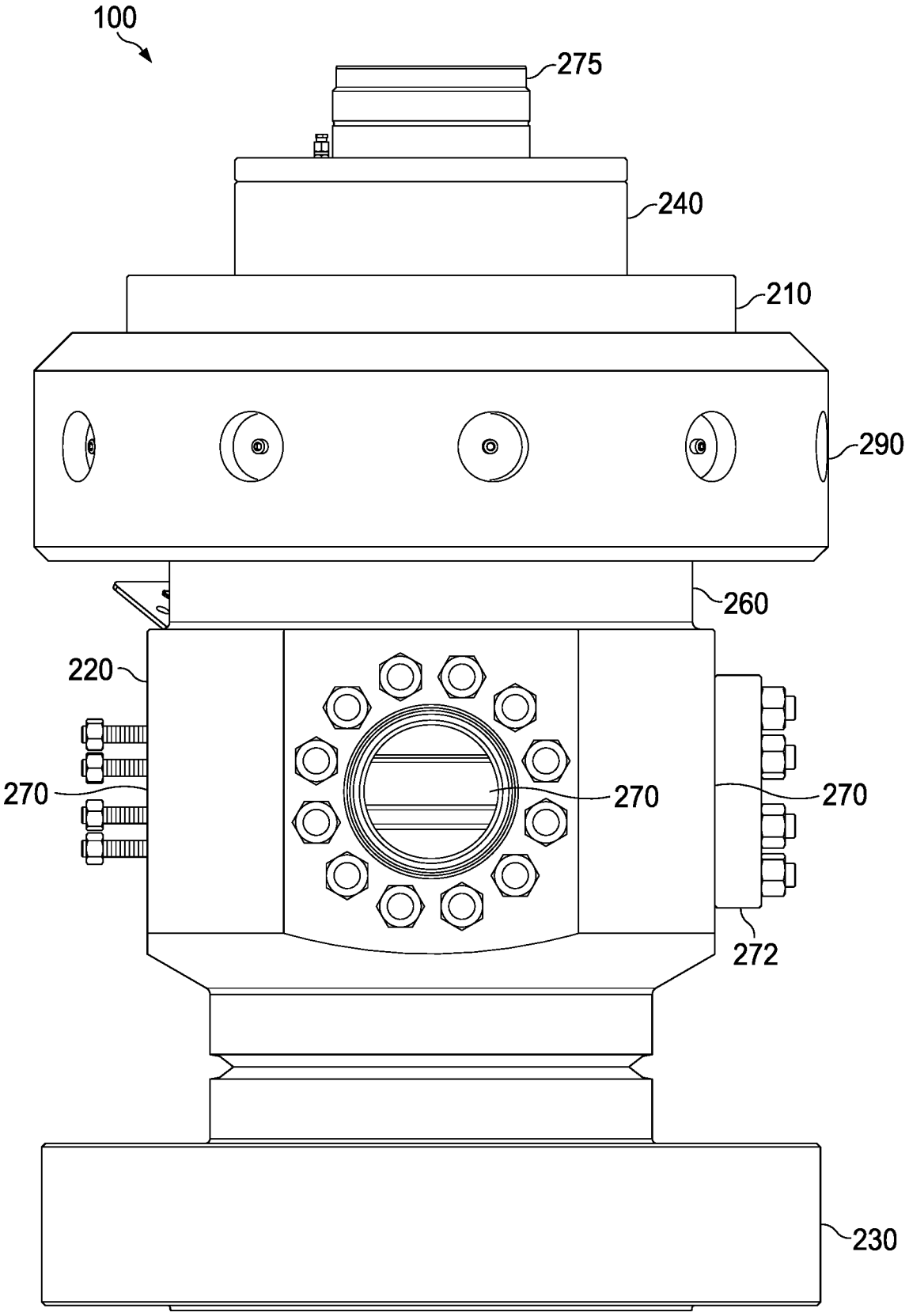
FIG. 3F shows a left-side elevation view of the improved rotating control device with shroud in accordance with one or more embodiments of the present invention.
Figure 3G:
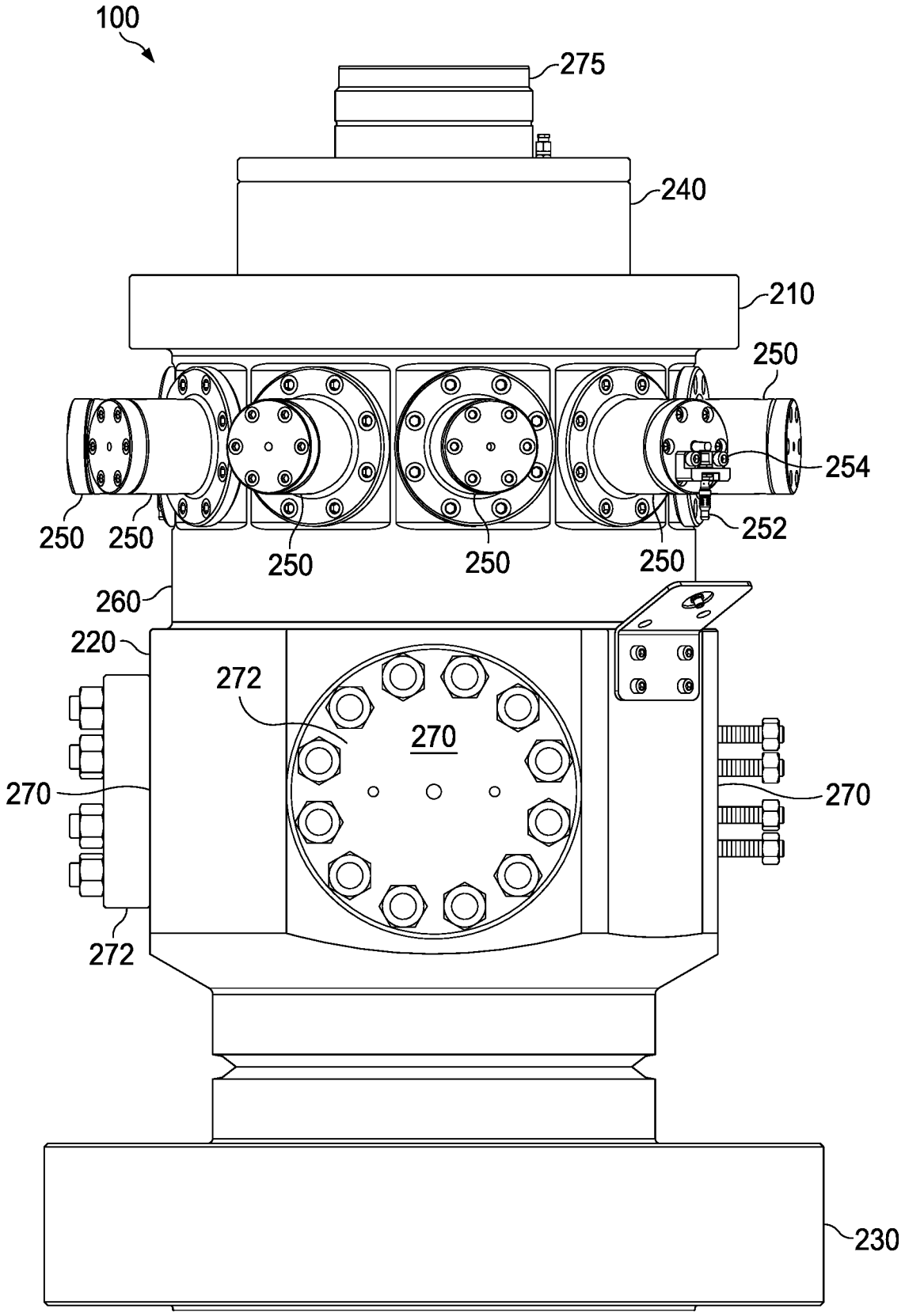
FIG. 3G shows a right-side elevation view of the improved rotating control device without shroud in accordance with one or more embodiments of the present invention.
Figure 3H:
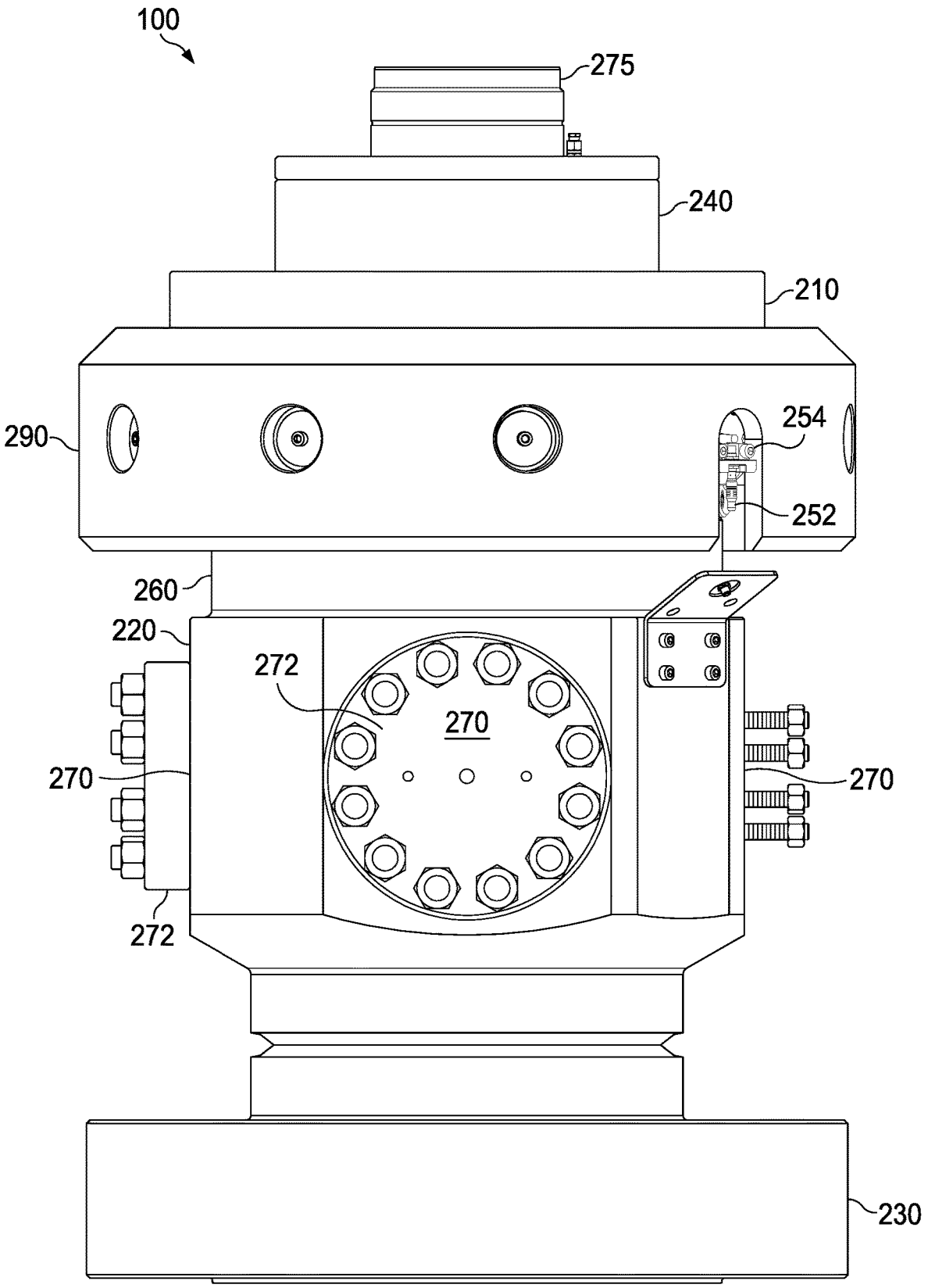
FIG. 3H shows a right-side elevation view of the improved rotating control device with shroud in accordance with one or more embodiments of the present invention.

Continuing, FIG. 3E shows a left-side elevation view of the improved rotating control device 100 without shroud in accordance with one or more embodiments of the present invention. Continuing, FIG. 3F shows a left-side elevation view of the improved rotating control device 100 with shroud 290 in accordance with one or more embodiments of the present invention. Continuing, FIG. 3G shows a right-side elevation view of the improved rotating control device 100 without shroud in accordance with one or more embodiments of the present invention. Continuing, FIG. 3H shows a right-side elevation view of the improved rotating control device 100 with shroud 290 in accordance with one or more embodiments of the present invention. One of ordinary skill in the art will recognize that the size, shape, and orientation of one or more fluid flow ports 270 may vary based on an application or design in accordance with one or more embodiments of the present invention.

Figure 3I:
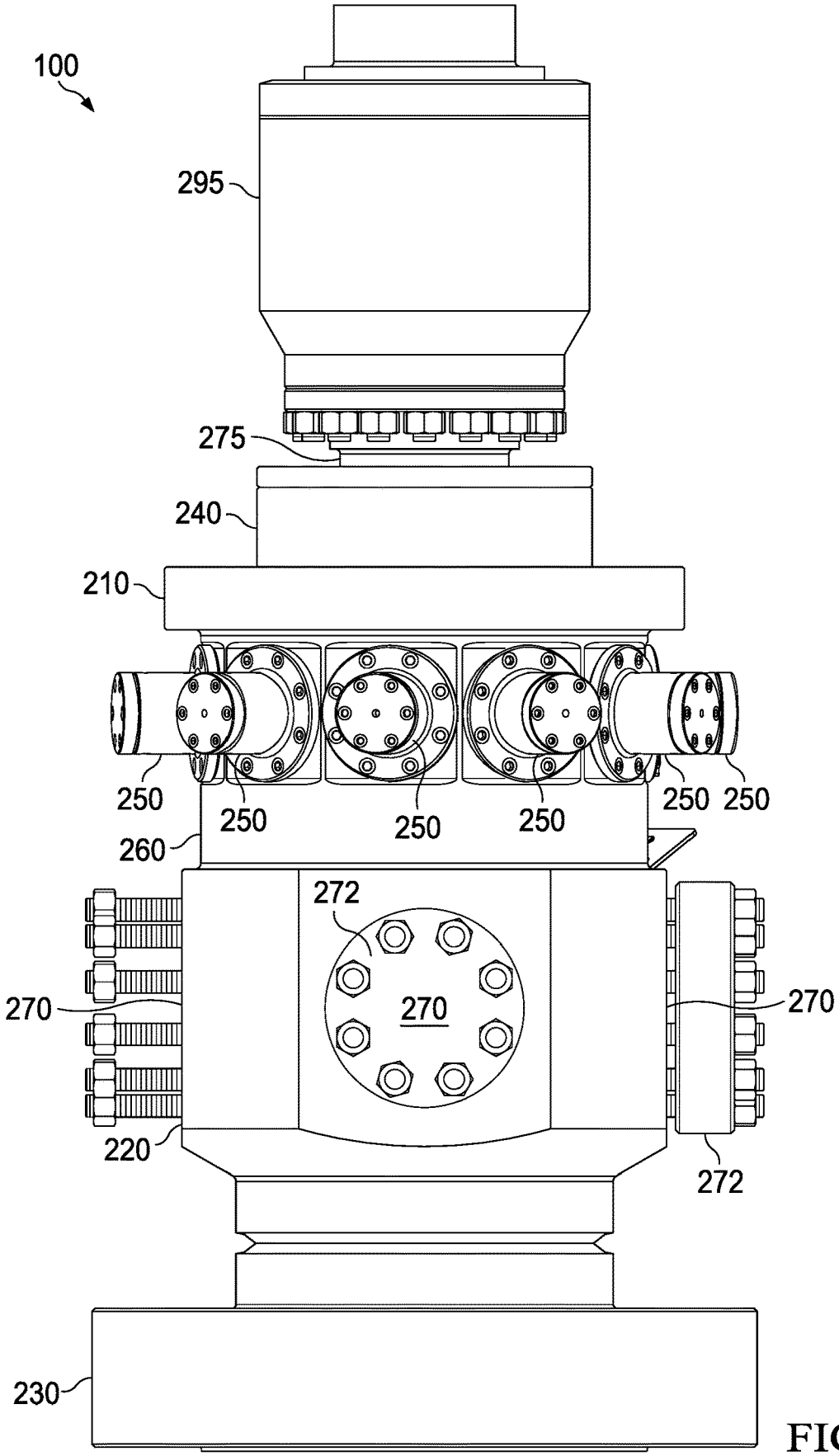
FIG. 3I shows a front elevation view of the improved rotating control device without shroud that includes an intra-overshot-pipe assembly in accordance with one or more embodiments of the present invention.
Figure 3J:
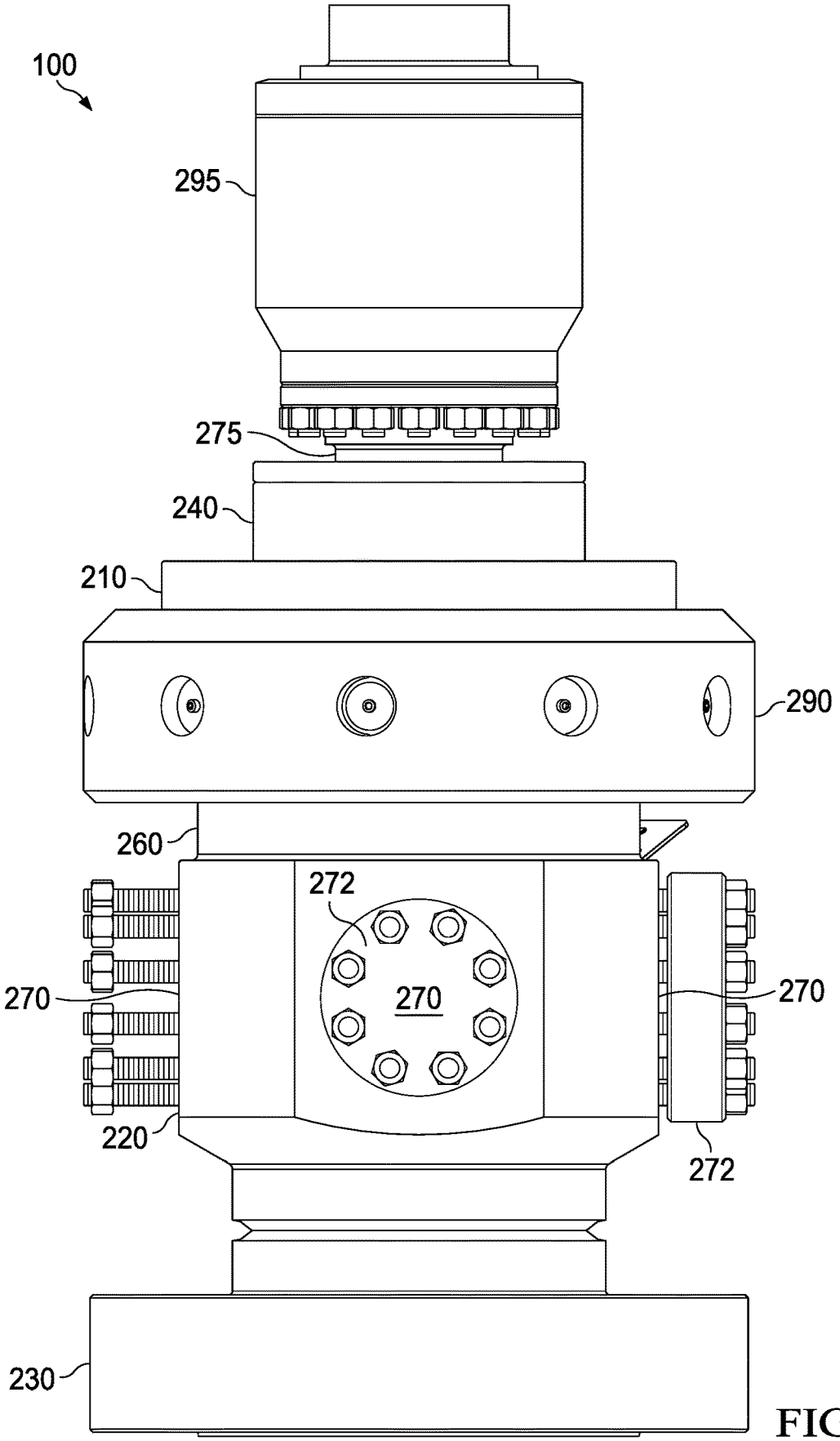
FIG. 3J shows a front elevation view of the improved rotating control device with shroud that includes the intra-overshot-pipe assembly in accordance with one or more embodiments of the present invention.

Continuing, FIG. 3I shows a front elevation view of the improved rotating control device 100 without shroud that includes an intra-overshot-pipe assembly 295 in accordance with one or more embodiments of the present invention. Intra-overshot-pipe assembly 295 may be removably attached to a top distal end of mandrel 275 of the seal and bearing assembly (e.g., 500 of FIG. 5). In certain embodiments, the removable attachment may be by threaded connection. The threaded connection may be configured such that it maintains tightness with rotation of a drill string (not shown) disposed therethrough. One of ordinary skill in the art will recognize other types or kinds of removable attachment may be used based on an application or design in accordance with one or more embodiments of the present invention. Continuing, FIG. 3J shows a front elevation view of the improved rotating control device 100 with shroud 290 that includes the intra-overshot-pipe assembly 295 in accordance with one or more embodiments of the present invention. Intra-overshot-pipe assembly 295 may be disposed and rotate within an overshot pipe (not shown) disposed above rotating control device 100 in the riser stack. Intra-overshot-pipe assembly 295 may rotate with mandrel 275 of the seal and bearing assembly (e.g., 500 of FIG. 5).

Figure 4A:
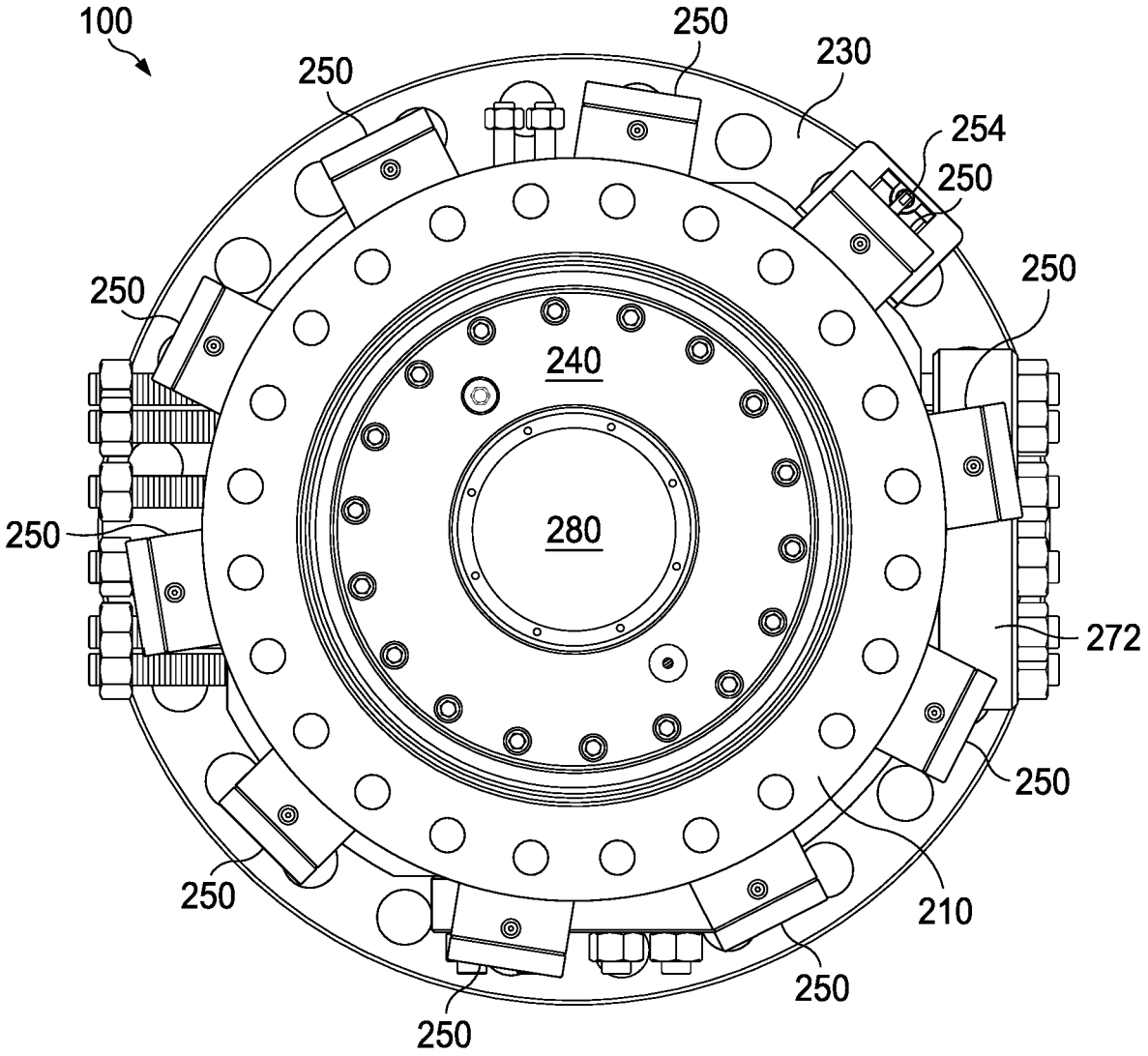
FIG. 4A shows a top plan view of an improved rotating control device without shroud in accordance with one or more embodiments of the present invention.
Figure 4B:
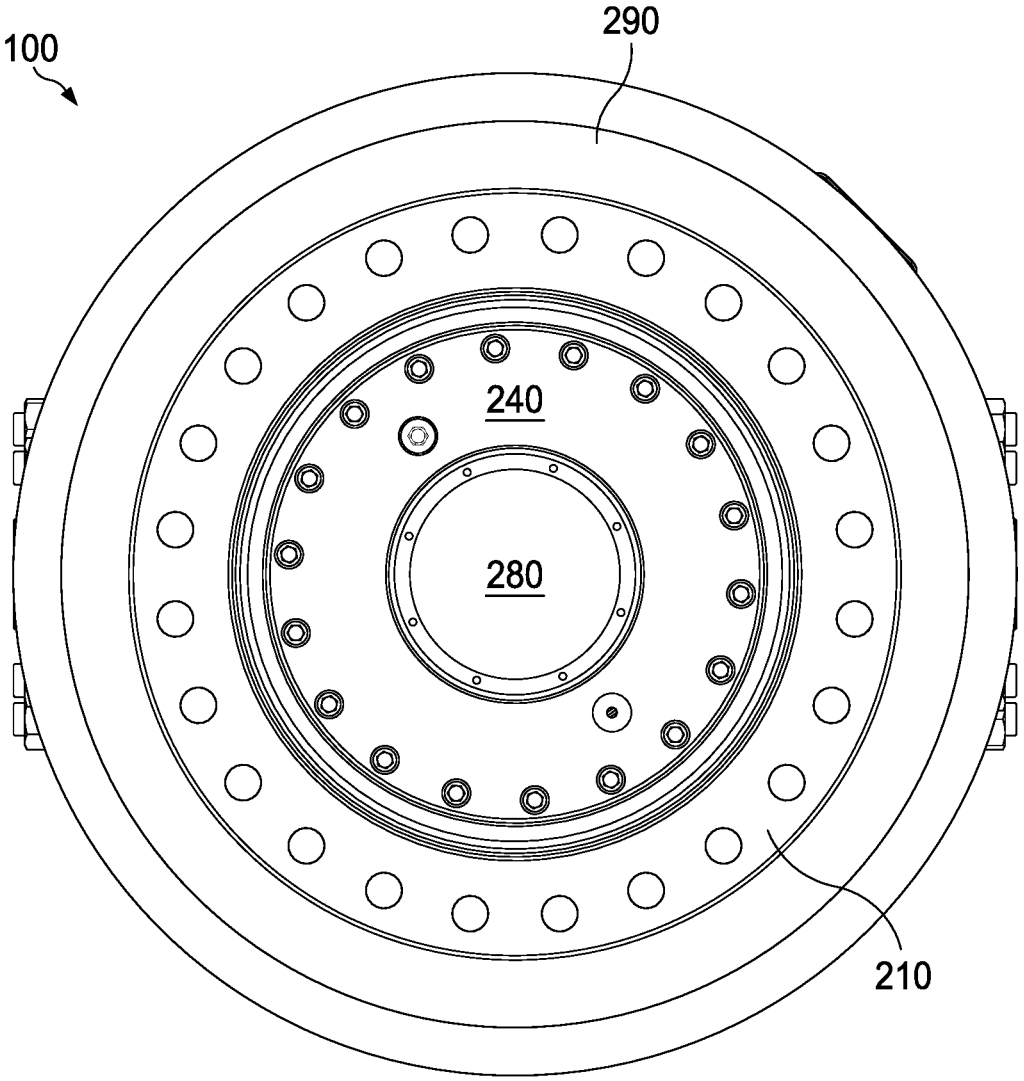
FIG. 4B shows a top plan view of the improved rotating control device with shroud in accordance with one or more embodiments of the present invention.
Figure 4C:
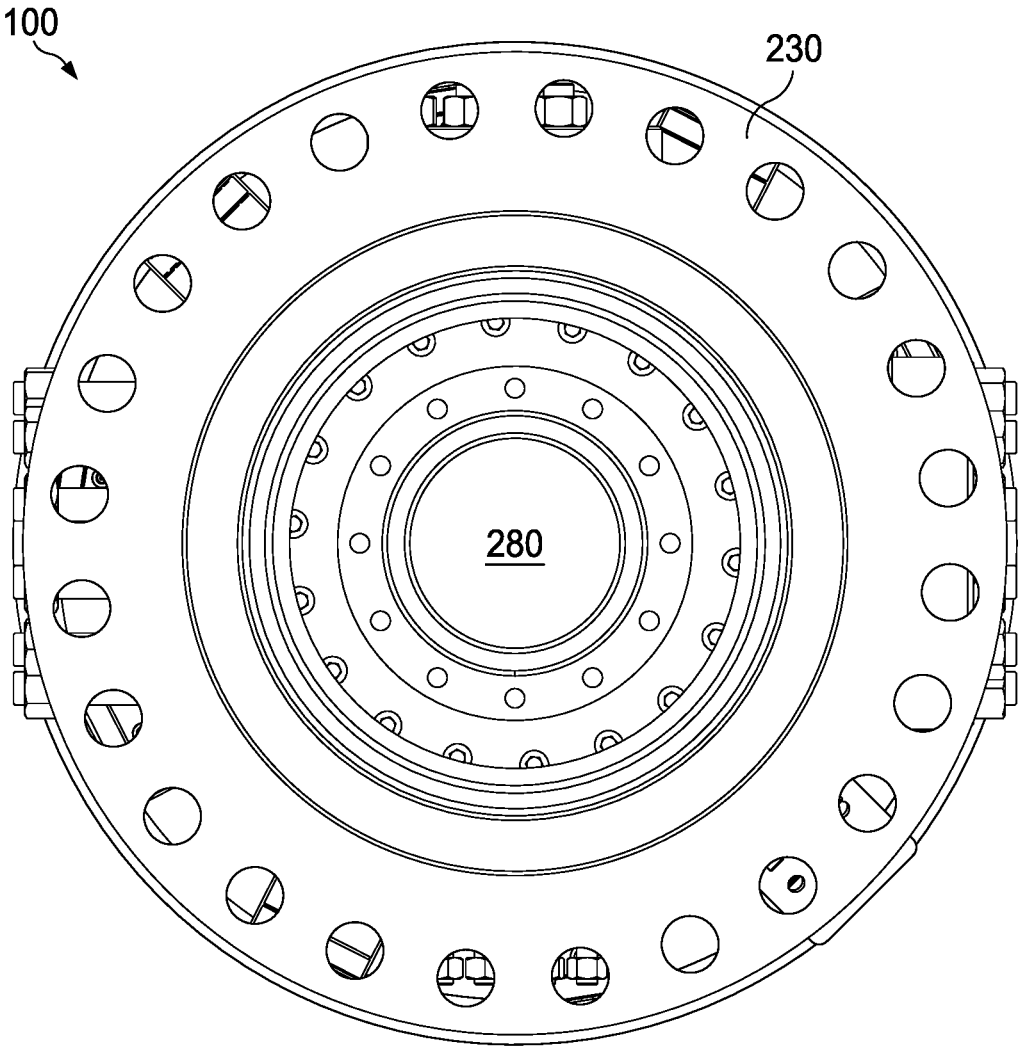
FIG. 4C shows a bottom plan view of the improved rotating control device without shroud in accordance with one or more embodiments of the present invention.
Figure 4D:
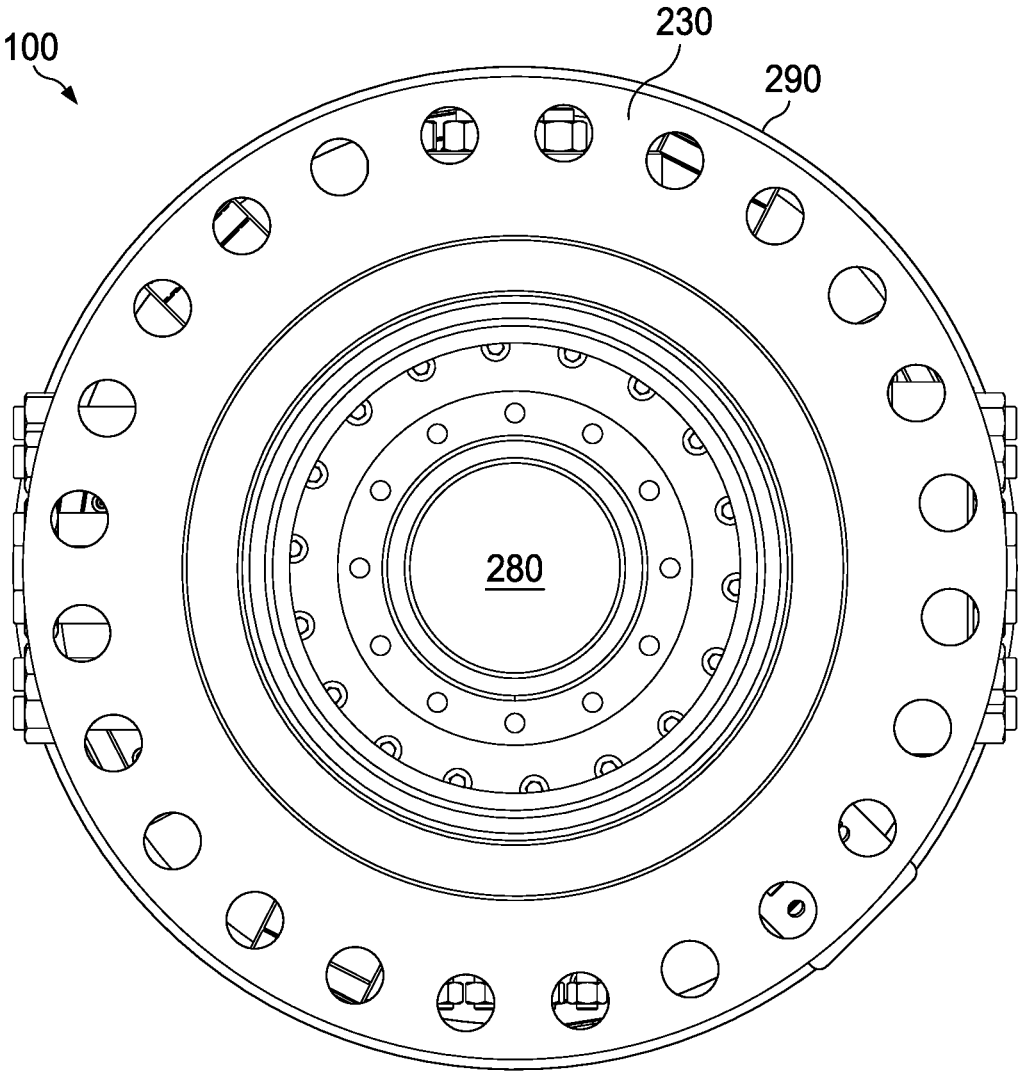
FIG. 4D shows a bottom plan view of the improved rotating control device with shroud in accordance with one or more embodiments of the present invention.

FIG. 4A shows a top plan view of an improved rotating control device 100 without shroud in accordance with one or more embodiments of the present invention. In the top plan view depicted, the distribution of the plurality of hydraulically-actuated fail-last-position latching assemblies 250 about an outer surface of bowl housing 220 is shown. As noted above, the number, size, and distribution of latching assemblies 250 may vary based on an application or design in accordance with one or more embodiments of the present invention. A common lumen 280, for receiving drill pipe (not shown), may extend from distal end to distal end of rotating control device 100. Continuing, FIG. 4B shows a top plan view of the improved rotating control device 100 with shroud 290 in accordance with one or more embodiments of the present invention. Continuing, FIG. 4C shows a bottom plan view of the improved rotating control device 100 without shroud in accordance with one or more embodiments of the present invention. Continuing, FIG. 4D shows a bottom plan view of the improved rotating control device 100 with shroud 290 in accordance with one or more embodiments of the present invention.

Figure 4E:
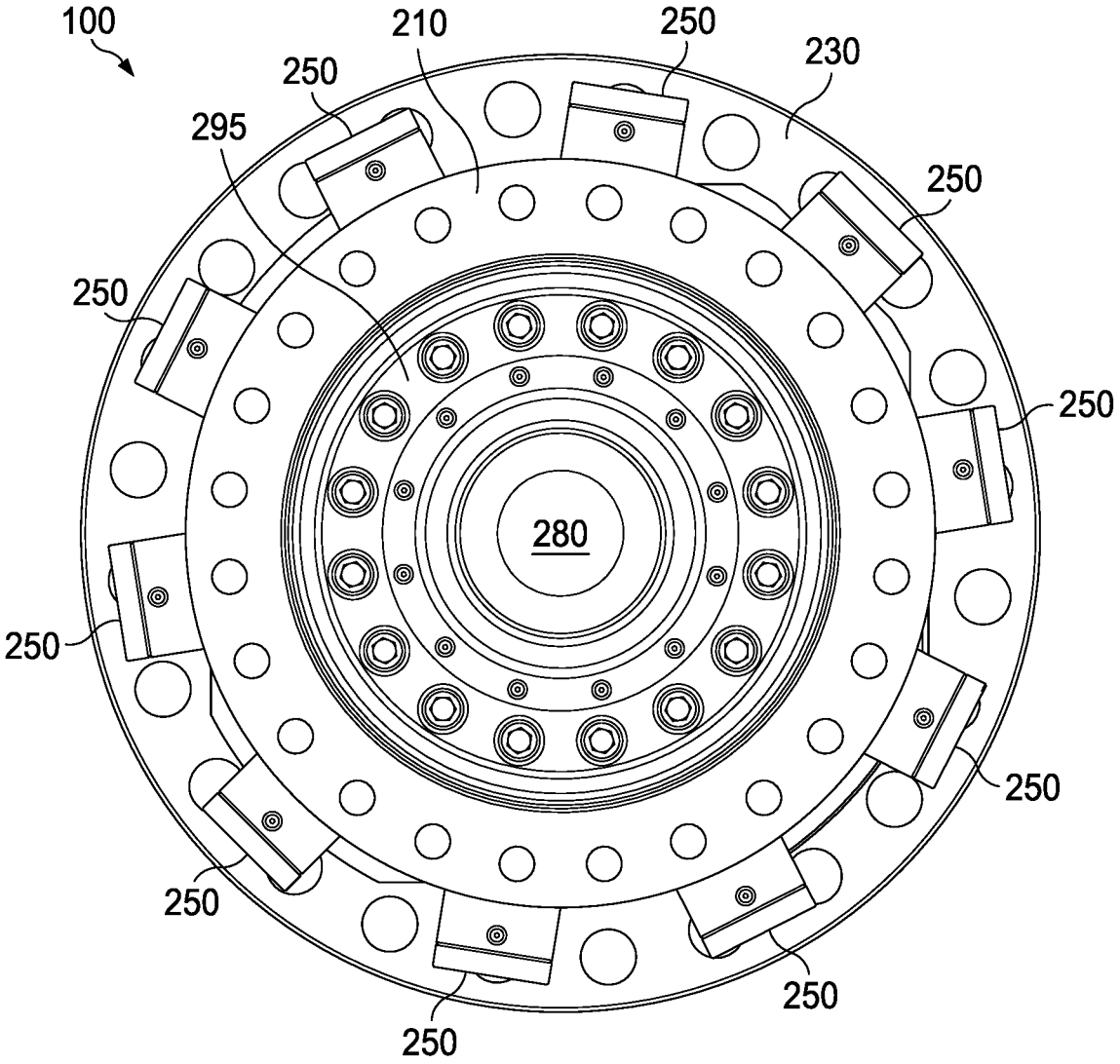
FIG. 4E shows a top plan view of the improved rotating control device without shroud that includes an intra-overshot-pipe assembly in accordance with one or more embodiments of the present invention.
Figure 4F:
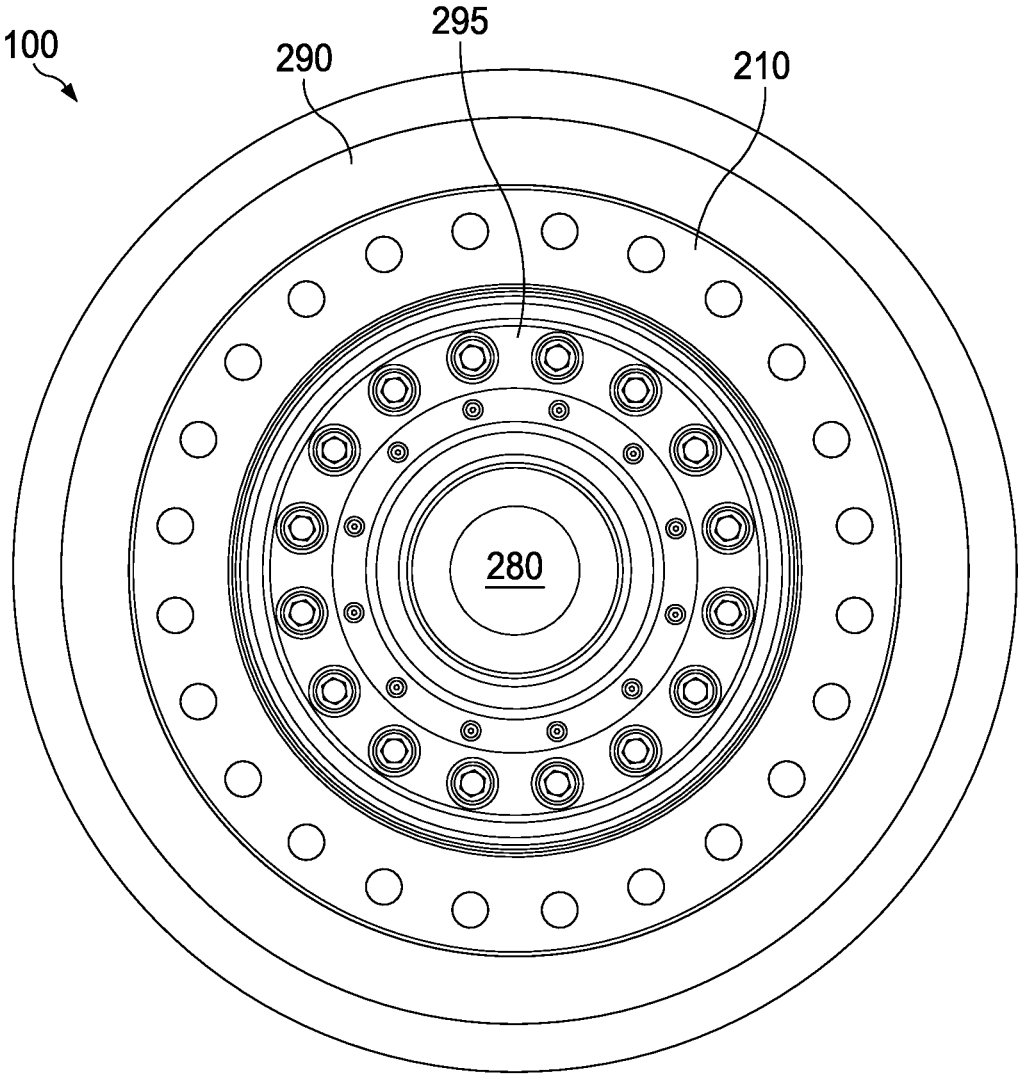
FIG. 4F shows a top plan view of the improved rotating control device with shroud that includes the intra-overshot-assembly in accordance with one or more embodiments of the present invention.

Continuing, FIG. 4E shows a top plan view of the improved rotating control device 100 without shroud that includes an intra-overshot-pipe assembly 295 in accordance with one or more embodiments of the present invention. Intra-overshot-pipe assembly 295 may have an outer diameter smaller than that of top flange 210 such that intra-overshot-pipe assembly 295 may be disposed and rotate within an overshot pipe (not shown) that may be bolted to top flange 210 of rotating control device 100. Continuing, FIG. 4F shows a top plan view of the improved rotating control device 100 with shroud 290 that includes the intra-overshot-pipe assembly 295 in accordance with one or more embodiments of the present invention. Intra-overshot-pipe assembly 295 may include a second interference-fit sealing element (not shown). Intra-overshot pipe assembly 295 may rotate with mandrel 275 of seal and bearing assembly 500. The common lumen 280 extends through intra-overshot-pipe assembly 295, top flange 210, the seal and bearing assembly (e.g., 500 of FIG. 5), and bottom flange (e.g., 230) and may vary in diameter along the passageway. The drill pipe (not shown) may be removably disposed therethrough and the first and second interference-fit sealing elements (not shown) may create an annular seal (not shown) within rotating control device 100.

Figure 5A:
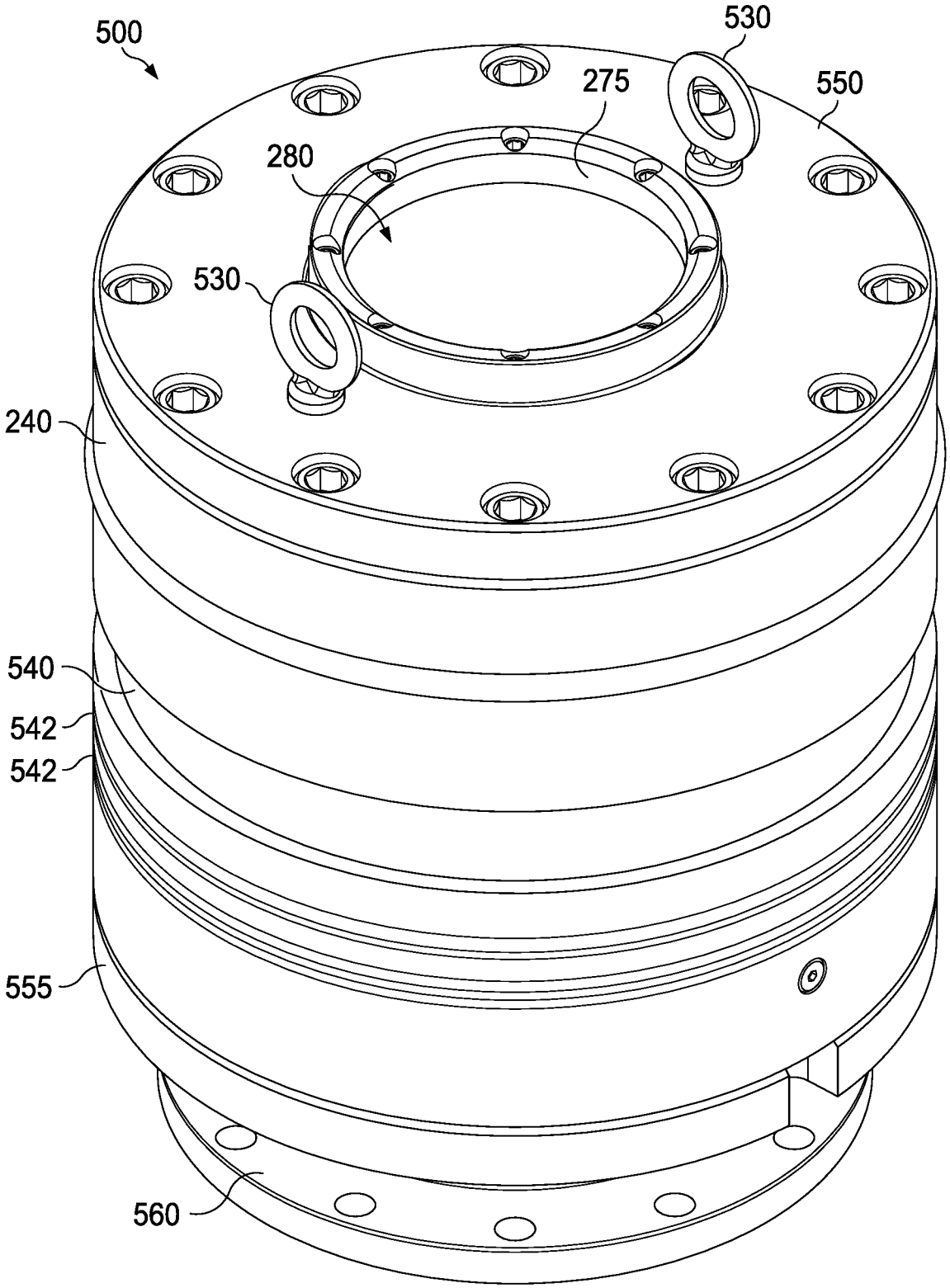
FIG. 5A shows a perspective view of a seal and bearing assembly in accordance with one or more embodiments of the present invention.

FIG. 5A shows a perspective view of a sealed seal and bearing assembly 500 in accordance with one or more embodiments of the present invention. Seal and bearing assembly 500 may include a seal and bearing housing 240, a rotating mandrel 275 disposed within an inner aperture of seal and bearing housing 240, a first interference-fit sealing element (not shown) attached to a bottom distal end of the mandrel (not independently illustrated) to perform a sealing function, a plurality of tapered-thrust bearings (not shown) indirectly mounted to seal and bearing housing 240 to facilitate rotation of the mandrel (not independently illustrated) and the first interference-fit sealing element (not shown), a preload spacer (not shown) disposed between top and bottom tapered-thrust bearings (not shown), and a plurality of jam nuts (not shown) to adjust a preload of the tapered-thrust bearings (not shown). Seal and bearing assembly 500 may include a top plate 550, also referred to as an upper seal carrier, attached to the top side of seal and bearing housing 240. A lower seal carrier 555 may be attached to the bottom side of seal and bearing housing 240 and a seal adapter 560 may be attached to a bottom distal end of mandrel 275 for attachment of the first interference-fit sealing element (not shown). A substantially rectangular groove 540 may be disposed about an outer surface of seal and bearing housing 240 to receive a plurality of substantially rectangular piston-driven dogs (not shown) when actuated by the plurality of hydraulically-actuated fail-last-position latching assemblies (not shown). One or more static seals 542 may be disposed about an outer surface of seal and bearing housing 240 to provide a static and non-rotating seal between seal and bearing housing 240 and the bowl housing (e.g., 220). A plurality of shop hooks 530 may be removably included to facilitate insertion and removal of seal and bearing assembly 500 into and from rotating control device 100.

Figure 5B:
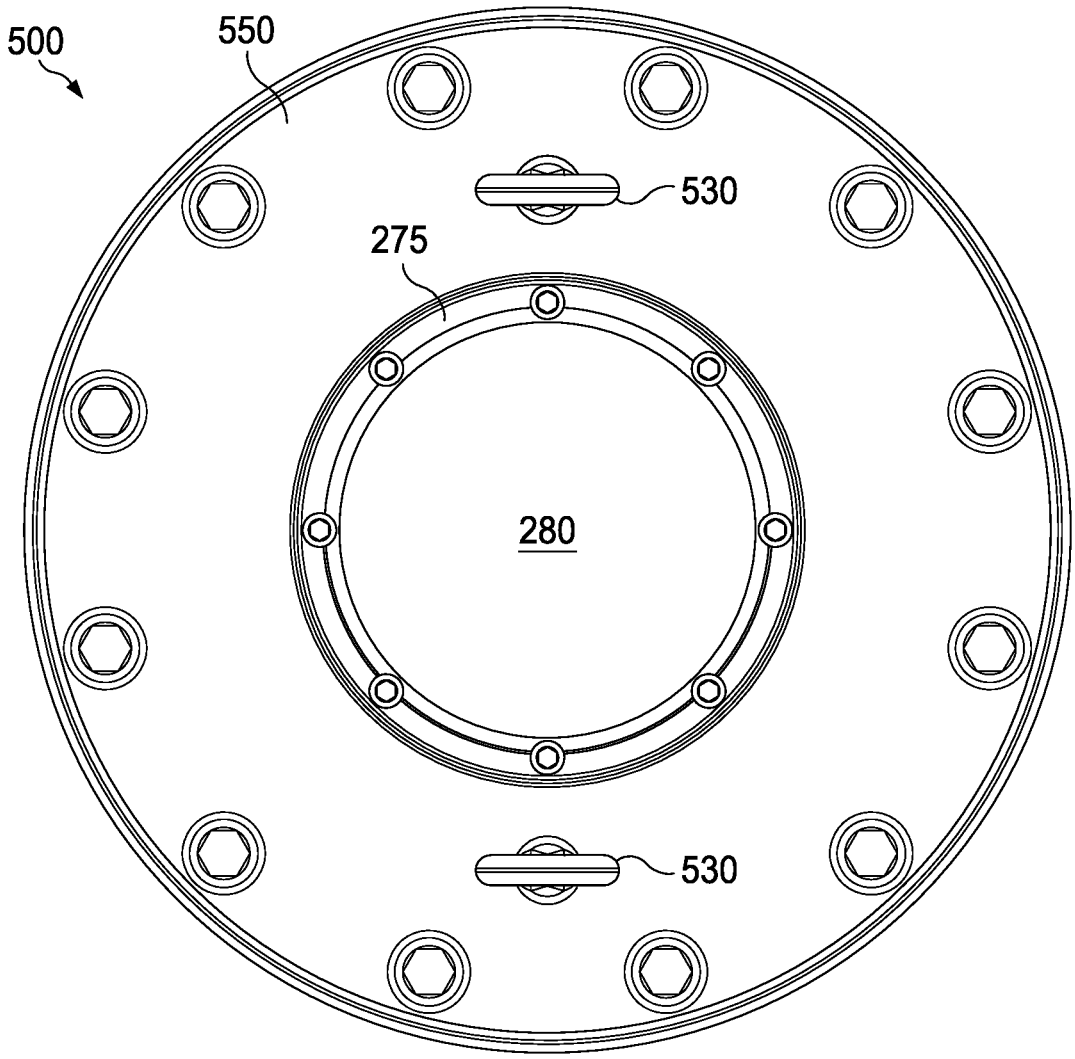
FIG. 5B shows a top plan view of the seal and bearing assembly in accordance with one or more embodiments of the present invention.
Figure 5C:
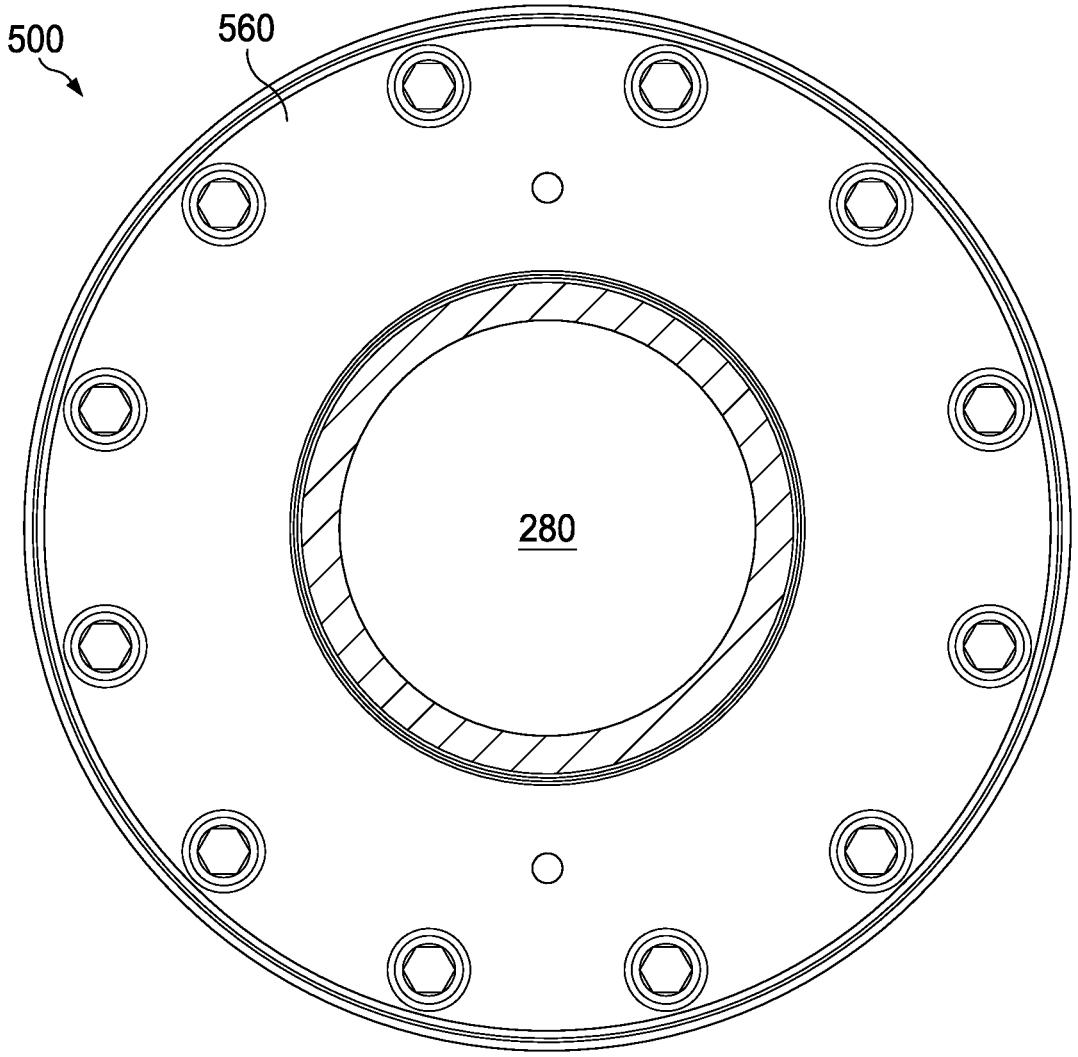
FIG. 5C shows a bottom plan view of the seal and bearing assembly in accordance with one or more embodiments of the present invention.

Continuing, FIG. 5B shows a top plan view of the seal and bearing assembly 500 in accordance with one or more embodiments of the present invention. A common lumen 280 may extend through seal and bearing assembly 500. While the first interference-fit sealing element (not shown) may have an inner aperture slightly smaller than the drill pipe (not shown) anticipated to be disposed therethrough, the lumen 280 extends from distal end to distal end of seal and bearing assembly 500. Continuing, FIG. 5C shows a bottom plan view of the seal and bearing assembly 500 in accordance with one or more embodiments of the present invention. Seal and bearing assembly 500 may include a seal adapter 560 disposed on a bottom of seal and bearing housing 240 of seal and bearing assembly 500. Seal adapter 560 may attach to the bottom distal end of the mandrel (not shown) of seal and bearing assembly 500 and be used to attach a first interference-fit sealing element (not shown).

Figure 5D:
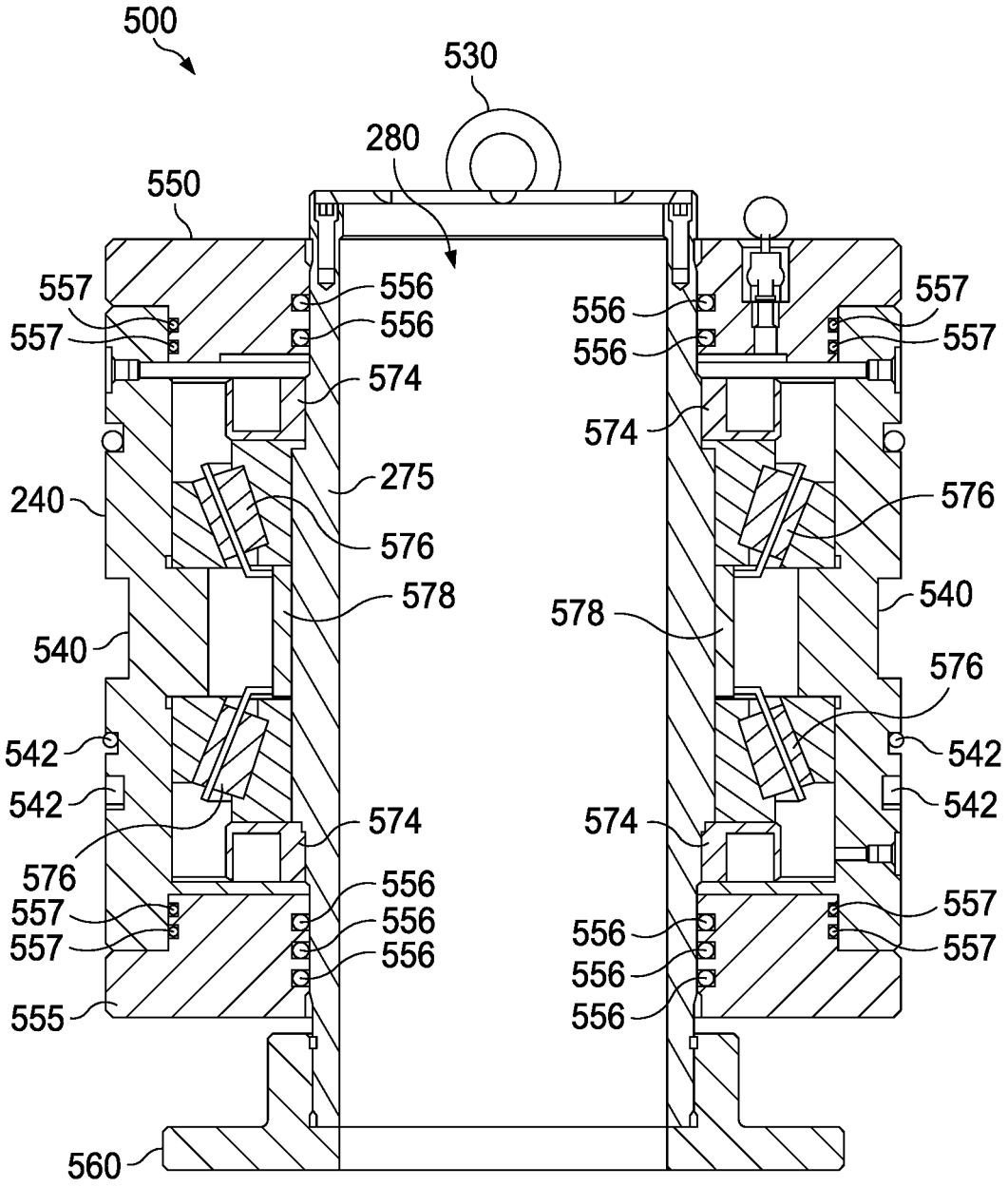
FIG. 5D shows a longitudinal cross section of the seal and bearing assembly in accordance with one or more embodiments of the present invention.

Continuing, FIG. 5D shows a longitudinal cross section of the seal and bearing assembly 500 in accordance with one or more embodiments of the present invention. Seal and bearing assembly 500 may include seal and bearing housing 240, a rotating mandrel 275 disposed within an inner aperture of seal and bearing housing 240, a first interference-fit sealing element (not shown) attached to a seal adapter 560 attached to the bottom distal end of mandrel 275, a plurality of tapered thrust-bearings 576 indirectly mounted to seal and bearing housing 240 to facilitate rotation of mandrel 275, a preload spacer 578 disposed between top and bottom tapered-thrust bearings 576, and a plurality of jam nuts 574 to adjust a preload of the tapered-thrust bearings 576. The plurality of tapered-thrust bearings 576 may be indirectly mounted to seal and bearing housing 240 at an offset angle to increase radial stability and prevent wear out from reciprocation of the drill pipe (not shown) disposed therethrough. A common lumen 280 extends from distal end to distal end of seal and bearing assembly 500. The plurality of jam nuts 574 may be threaded such that they maintain preload with rotation of the drill pipe (not shown).

Seal and bearing housing 240 may include a groove 540 that is substantially rectangular and non-tapered to receive a plurality of substantially rectangular piston-driven dogs (not shown) to controllably secure seal and bearing assembly 500 to rotating control device 100. One of ordinary skill in the art will recognize that the shape of the piston-driven dogs (not shown) and mating groove 540 may vary in shape and size in accordance with one or more embodiments of the present invention. One or more static sealing elements 542 may be disposed about an outer surface of seal and bearing housing 240 to provide a static seal between seal and bearing housing 240 and the bowl housing (e.g., 220). Lower seal carrier 555 may include a plurality of dynamic sealing elements 556 that contact rotating mandrel 275 and a plurality of static sealing elements 557 that contact seal and bearing housing 240. Upper seal carrier 550 may also include a plurality of dynamic sealing elements 556 and a plurality of static sealing elements 557.

FIG. 6A shows a top plan view of an improved rotating control device 100 with shroud 290 that includes an intra-overshot-pipe assembly 295 showing a cut line for a cross section depicted in FIG. 6B in accordance with one or more embodiments of the present invention. Continuing, FIG. 6B shows a longitudinal cross section of the improved rotating control device 100 with shroud 290 that includes the optional intra-overshot-pipe assembly 295 showing engagement of the plurality of hydraulically-actuated piston-driven dogs 620 in accordance with one or more embodiments of the present invention. A seal adapter 560 may be attached to a bottom distal end of mandrel 275. A first interference-fit sealing element 650 may be attached to seal adapter 560. For example, sealing element 650 may be bolted to seal adapter 560. Each of a plurality of hydraulically-actuated fail-last-position latching assemblies 250 may include a piston-driven 610 dog 620 that fits within groove 540 of seal and bearing housing 240, thereby providing retention. Sealing elements 542, 556, 557 and first interference-fit sealing element 650 may seal an annulus between the drill pipe (not shown) and bowl housing 220. During drilling operations, the returning annular fluids may be directed from rotating control device 100 to the surface by way of one or more of the fluid flow ports (e.g., 270 of FIG. 7A).

In certain embodiments, rotating control device 100 may include an intra-overshot-pipe assembly 295 removably attached to a top distal end of mandrel 275 by adapter 640. Intra-overshot-pipe assembly 295 may include an intra-overshot-pipe housing 655 and a seal adapter 660 attached to housing 655 where a second interference-fit sealing element 630 may be attached to a bottom distal end of seal adapter 660. Intra-overshot-pipe assembly 295 may be disposed within an overshot pipe (not shown) and rotate with mandrel 275 when a drill pipe (not shown) is disposed therethrough. The optional second interference-fit sealing element 630 may form a redundant seal the annulus surrounding the drill pipe (not shown).

The first interference-fit sealing element 650, mandrel 275, and optional second interference-fit sealing element 630 may rotate with the drill pipe (not shown). The first 650 and the second 630 interference-fit sealing element may be composed of natural rubber, nitrile butadiene rubber, hydrogenated nitrile butadiene rubber, polyurethane, elastomeric material, or combinations thereof. The first interference-fit sealing element 650 may include a first seal lumen having a first seal inner aperture slightly smaller than an outer diameter of the drill pipe (not shown) and the second interference-fit sealing element 630 may include a second seal lumen having a second seal inner aperture slightly smaller than an outer diameter of the drill pipe (not shown). The second seal lumen, the top flange lumen, the mandrel lumen, the first seal lumen, and the bottom flange lumen may form a common lumen 280 that extends from distal end to distal end of rotating control device 100. One of ordinary skill in the art will recognize that the lumens of each component may have a diameter that varies from component to component. During drilling operations, a drill pipe (not shown) may be disposed through the common lumen 280, whereby a first and a second seal are established, in part, by the first interference-fit sealing element 650 and the second interference-fit sealing element 630. The wellbore pressure may be managed by a surface-backpressure choke manifold (not shown) disposed on the surface of the platform (not shown) that manipulates the fluid flow rate from one or more fluid flow ports (e.g., 270 of FIG. 7A) to the surface.

Figure 6C:
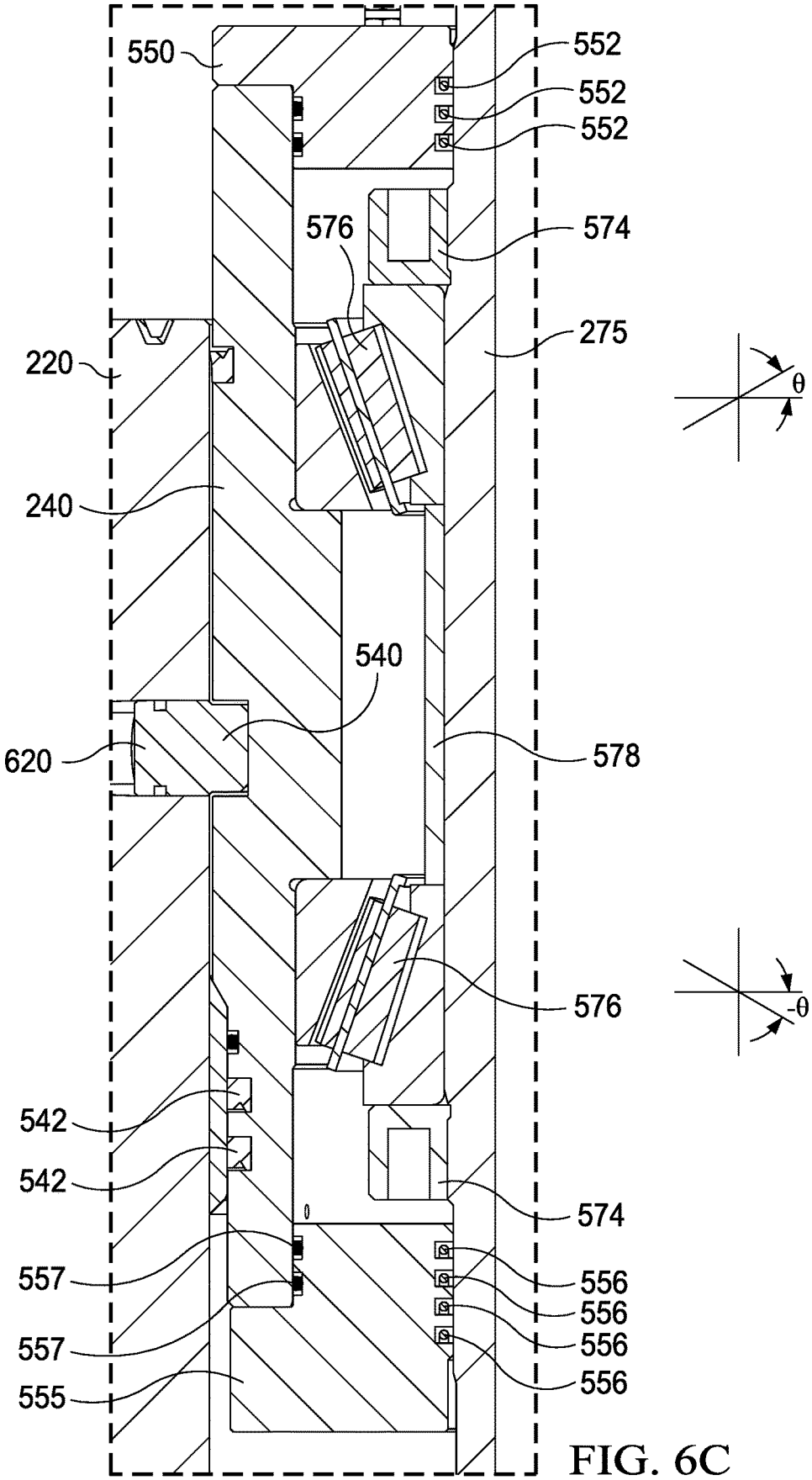
FIG. 6C shows a detailed cross-sectional view of a portion of seal and bearing assembly showing engagement of the plurality of hydraulically-actuated piston-driven dogs, tapered-thrust bearings, preload spacer, and jam nuts in accordance with one or more embodiments of the present invention.

Continuing, FIG. 6C shows a detailed cross-sectional view of a portion of seal and bearing assembly 500 showing engagement of the plurality of hydraulically-actuated piston-driven dogs 620, tapered-thrust bearings 576, preload spacer 578, and jam nuts 574 in accordance with one or more embodiments of the present invention. A plurality of tapered-thrust bearings 576 may be indirectly mounted at an offset angle to increase radial stability.

In certain embodiments, the top tapered-thrust bearings 576 may be indirectly mounted at an offset angle, θ, in a range between 10 degrees and 40 degrees from a perpendicular line to a longitudinal axis of rotating control device 100. In other embodiments, the top tapered-thrust bearings 576 may be indirectly mounted at an offset angle, θ, in a range between 20 degrees and 30 degrees from a perpendicular line to a longitudinal axis of rotating control device 100. In still other embodiments, the top tapered-thrust bearings 576 may be indirectly mounted at an offset angle, θ, in a range between 0 degrees and 50 degrees from a perpendicular line to a longitudinal axis of rotating control device 100. One of ordinary skill in the art will recognize that the positive offset angle of the top tapered-thrust bearings 576 may vary based on an application or design in accordance with one or more embodiments of the present invention.

The bottom tapered-thrust bearings 576 may be indirectly mounted at an offset angle, −θ, in a range between −10 degrees and −40 degrees from a perpendicular line to a longitudinal axis of rotating control device 100. In other embodiments, the bottom tapered-thrust bearings 576 may be indirectly mounted at an offset angle, −θ, in a range between −20 degrees and −30 degrees from a perpendicular line to a longitudinal axis of rotating control device 100. In still other embodiments, the top tapered-thrust bearings 576 may be indirectly mounted at an offset angle, −θ, in a range between 0 degrees and −50 degrees from a perpendicular line to a longitudinal axis of rotating control device 100. One of ordinary skill in the art will recognize that the negative offset angle of the bottom tapered-thrust bearings 576 may vary based on an application or design in accordance with one or more embodiments of the present invention.

A plurality of jam nuts 574 may be used to preload the plurality of tapered-thrust bearings 576, the top and bottom of which, are separated by a preload spacer 578. The jam nuts 574 may be tightened or loosened to adjust a preload on the tapered-thrust bearings 576 and preload spacer 578. Upper seal carrier 550, the plurality of jam nuts 574, and lower seal carrier 555 may be threaded or otherwise attached such that they maintain the preload during rotation of the drill pipe (not shown).

Figure 7A:
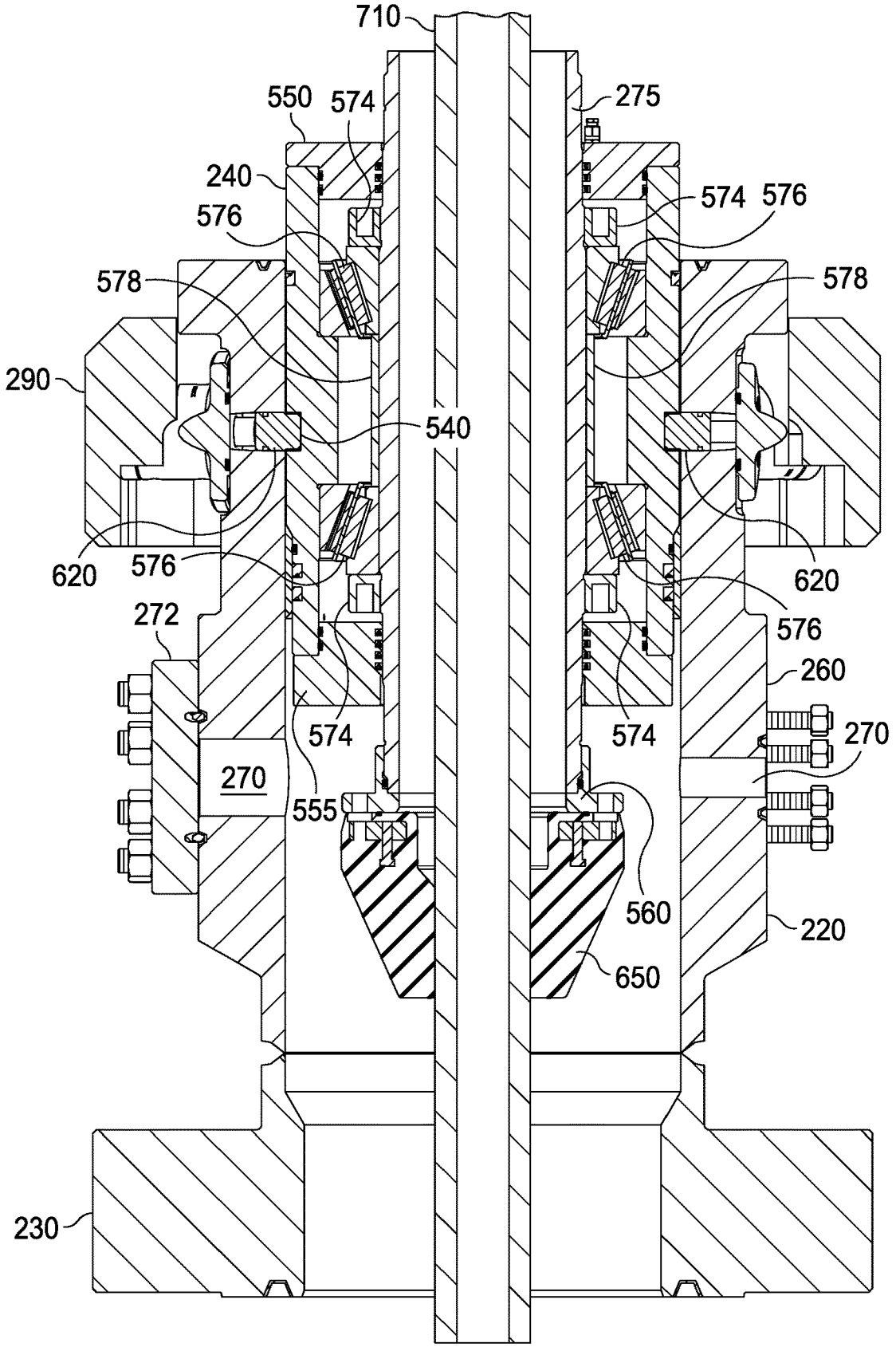
FIG. 7A shows a longitudinal cross section of an improved rotating control device with shroud showing seal engagement with drill pipe in accordance with one or more embodiments of the present invention.

FIG. 7A shows a longitudinal cross section of an improved rotating control device 100 with shroud 290 showing seal engagement with drill pipe 710 in accordance with one or more embodiments of the present invention. When the drill string is tripped in, drill pipe 710 may be disposed through the common lumen 280 of rotating control device 100. The first interference-fit sealing element 650 may form a seal about drill pipe 710, thereby sealing the annulus between drill pipe 710 and bowl housing 220. The returning annular fluids (not shown) may be diverted from bowl housing 220 to the surface of the platform (not shown) by way of one or more fluid flow ports 270.

Figure 7B:
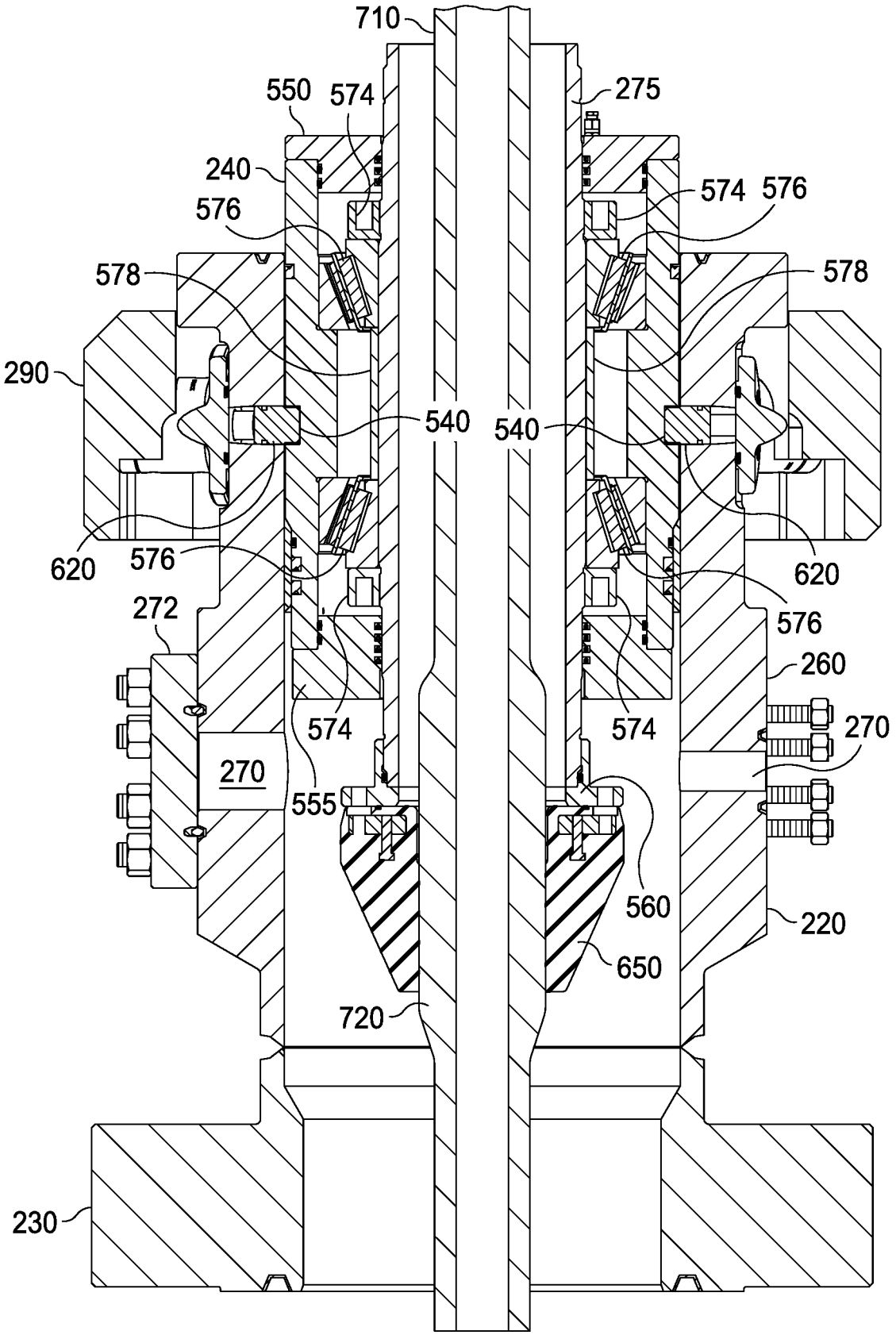
FIG. 7B shows a longitudinal cross section of the improved rotating control device with shroud showing seal engagement with drill pipe having a tool joint in accordance with one or more embodiments of the present invention.

Continuing, FIG. 7B shows a longitudinal cross section of the improved rotating control device 100 with shroud 290 showing seal engagement with drill pipe 710 having a tool joint 720 in accordance with one or more embodiments of the present invention. Because the first 650 and the second (not shown) interference-fit sealing elements are composed of flexible materials, when drill pipe 710 may be tripped into or out of the hole, a tool joint 720 may pass through rotating control device 100 while maintaining the annular seal. In this way, pressure may be maintained during tripping in and out of the hole.

Figure 8A:
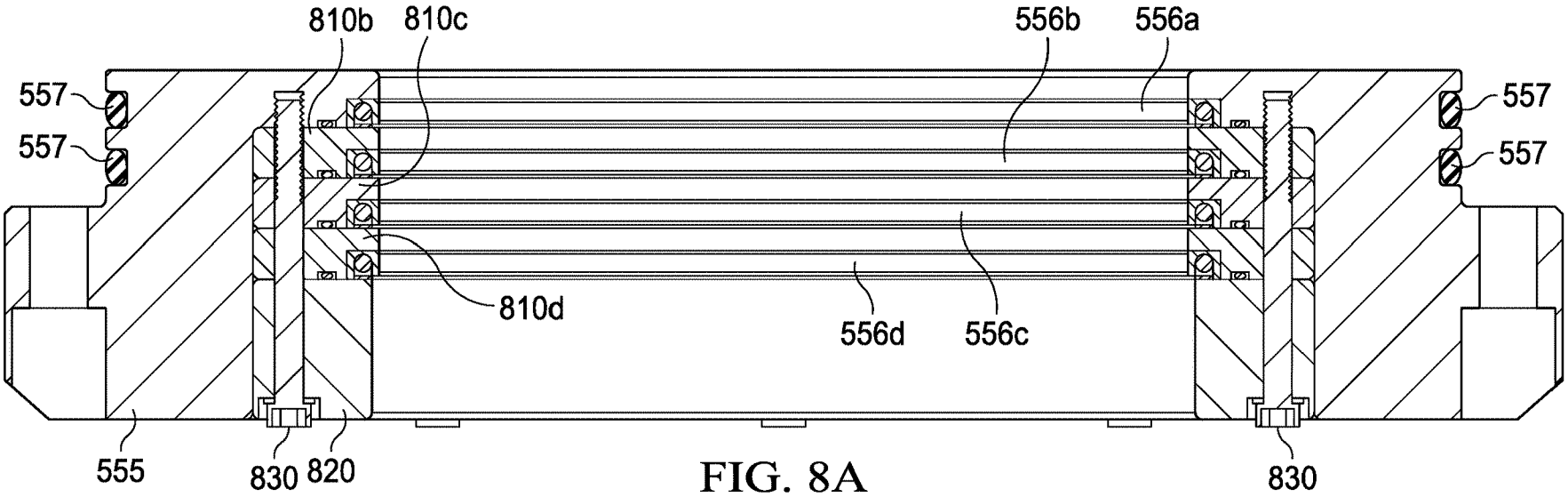
FIG. 8A shows a cross-sectional view of a lower seal carrier of a seal and bearing assembly in accordance with one or more embodiments of the present invention.

FIG. 8A shows a cross-sectional view of a lower seal carrier 555 of a seal and bearing assembly 500 in accordance with one or more embodiments of the present invention. The proper function of the plurality of sealing elements 556 is critically important to maintain the annular seal surrounding the drill pipe (not shown). In embodiments previously depicted, the plurality of sealing elements 556 were disposed in grooves formed on an inner circumferential surface of the lower seal carrier 555 itself. Because of their location, it has been discovered that, over time, these sealing elements 556 wear into the carrier 555 and become very difficult to remove and ultimately replace. Typically, a field hand must use a screw driver or other blunt instrument to pry the worn sealing elements 556 off of the lower seal carrier 555, potentially damaging the seal carrier 555 and impacting its ability to maintain the annular seal. As such, in certain embodiments, lower seal carrier 555 may be modified as shown in FIGS. 8A through 8C to include a plurality of removable seal carrier trays 810 and a seal plate 820 to facilitate the quick and easy removal and replacement of sealing elements 556 in the field.

Figure 8B:
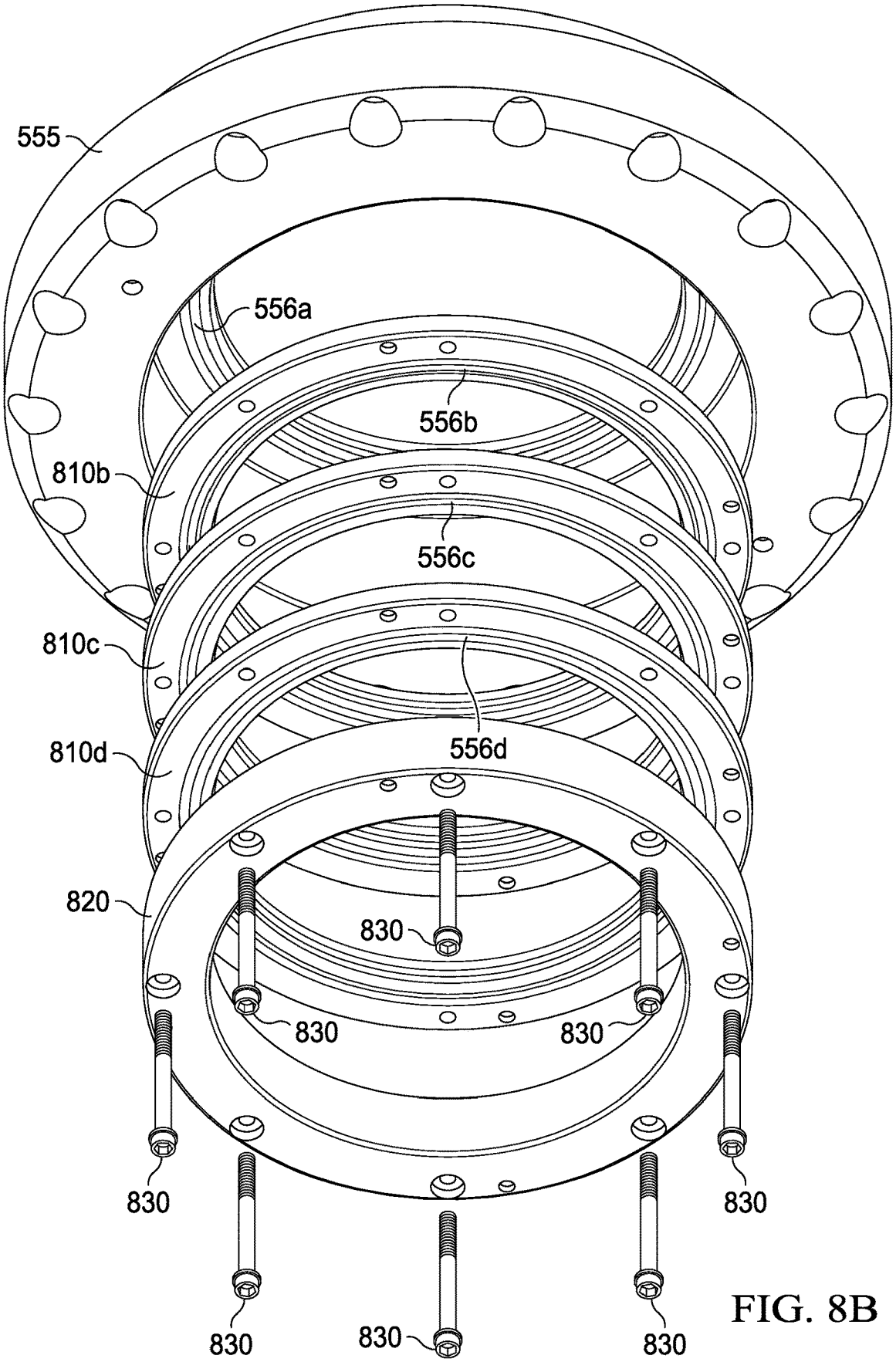
FIG. 8B shows an exploded bottom-facing perspective view of the lower seal carrier of the seal and bearing assembly in accordance with one or more embodiments of the present invention.

Continuing, FIG. 8B shows an exploded bottom-facing perspective view of the lower seal carrier 555 of the seal and bearing assembly 500 in accordance with one or more embodiments of the present invention. A first sealing element 556*a* may be disposed in a groove formed in lower seal carrier 555. Each of a second 556*b*, a third 556*c*, and a fourth 556*d* sealing element may be disposed in their own respective seal carrier trays 810. Each seal carrier tray 810 includes an inner circumferential surface that receives a sealing element 556 and a plurality of mounting holes (not independently illustrated) to receive a plurality of mounting bolts 830. As such, when installing the plurality of sealing elements 556, a first sealing element 556*a* may be disposed within the groove formed in lower seal carrier 555, a second sealing element 556*b* may be disposed within a seal carrier tray 810*b* and tray 810*b* may be disposed within lower seal carrier 555, a third sealing element 556*c* may be disposed within a seal carrier tray 810*c* and tray 810*c* may be disposed within lower seal carrier 555, and a fourth sealing element 556*d* may be deposed within seal carrier tray 810*d* and tray 810*d* may be disposed within lower seal carrier 555. A seal plate 820 may be disposed over the fourth sealing element 556*d* and a plurality of bolts 830 may be used to secure seal plate 820, as well as the plurality of sealing elements 556 disposed within their respective seal trays 810, to lower seal carrier 555.

Figure 8C:
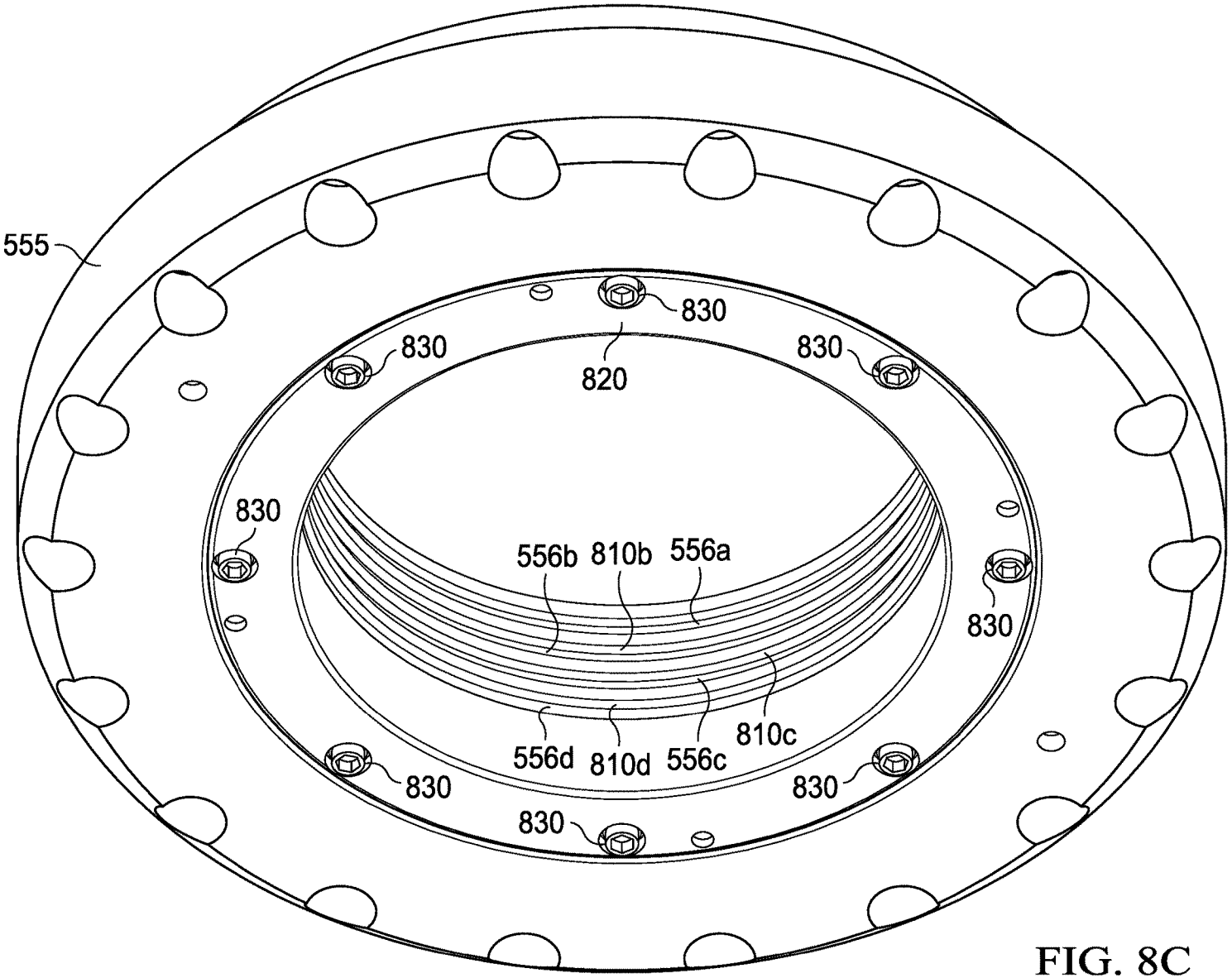
FIG. 8C shows a bottom-facing perspective view of the lower seal carrier of the seal and bearing assembly in accordance with one or more embodiments of the present invention.

Continuing, FIG. 8C shows a bottom-facing perspective view of the lower seal carrier 555 of the seal and bearing assembly 500 in accordance with one or more embodiments of the present invention. Once modified lower seal carrier 555 has been assembled, it may be installed as part of seal and bearing assembly 500 in exactly the same manner as other embodiments described herein and functions the same way. While the modified lower seal carrier 555 includes four (4) sealing elements, one of ordinary skill in the art will recognize that the plurality of sealing elements 556 may vary based on an application or design in accordance with one or more embodiments of the present invention.

Advantages of one or more embodiments of the present invention may include one or more of the following:

In one or more embodiments of the present invention, an improved rotating control device has a simplified design that includes fewer parts, costs less to manufacture, reduces cost of ownership, and has a reduced and less expensive maintenance schedule.

In one or more embodiments of the present invention, an improved rotating control device provides a unique seal carrier design that allows bearing assemblies to be easily serviced or replaced with a significant reduction in non-productive time and associated costs.

In one or more embodiments of the present invention, an improved rotating control device includes a unique seal carrier design with highly accurate bearing preload that extends the productive life of the rotary seal. The seal carrier can be removed without having to refurbish the internal bearings. The preload of the bearings may be precisely managed without the use of springs or shims.

In one or more embodiments of the present invention, an improved rotating control device includes indirectly mounted tapered-thrust bearings that increase radial load capacity and stability.

In one or more embodiments of the present invention, an improved rotating control device includes pilot operated, and hydraulically actuated, latching dogs that fail in their last position to ensure engagement when power is lost.

In one or more embodiments of the present invention, an improved rotating control device includes an optional secondary sealing element for disposition within an overshot pipe or bell nipple.

In one or more embodiments of the present invention, an improved rotating control device provides improved static ratings from 500 pounds per square inch ("PSI") to 5000 PSI.

In one or more embodiments of the present invention, an improved rotating control device provides improved rotation rate up to at least 220 revolutions per minute ("RPM").

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A seal and bearing assembly for a rotating control device for jackup rigs comprising:

a seal and bearing housing;

a rotatable mandrel disposed within an inner aperture of the seal and bearing housing;

an upper seal carrier attached to a top side of the seal and bearing housing comprising a dynamic sealing element that contacts the rotatable mandrel;

a plurality of tapered-thrust bearings to facilitate rotation of the rotatable mandrel, wherein the plurality of tapered-thrust bearings comprise top tapered-thrust bearings indirectly mounted at a positive offset angle from a perpendicular line to a longitudinal axis of the rotating control device and bottom tapered-thrust bearings indirectly mounted at a negative offset angle from the perpendicular line to the longitudinal axis of the rotating control device;

a preload spacer disposed between the top and bottom tapered-thrust bearings; and a lower seal carrier attached to a bottom side of the seal and bearing housing comprising a plurality of removable seal carrier trays, wherein a plurality of dynamic sealing elements that contact the rotatable mandrel are removably disposed within the plurality of removable seal carrier trays.

2. The seal and bearing assembly of claim 1, further comprising:

a lubricating grease disposed within the seal and bearing housing to lubricate the plurality of tapered-thrust bearings.

3. The sealed seal and bearing assembly of claim 1, wherein the top tapered-thrust bearings are indirectly mounted at an offset angle in a range between 10 degrees and 40 degrees from the perpendicular line to the longitudinal axis of the rotating control device.

4. The sealed seal and bearing assembly of claim 1, wherein the bottom tapered-thrust bearings are indirectly mounted at an offset angle in a range between −10 degrees and −40 degrees from the perpendicular line to the longitudinal axis of the rotating control device.

5. The sealed seal and bearing assembly of claim 1, wherein the back-to-back orientation of the top and bottom tapered-thrust bearings increases radial stability.

6. A rotating control device for jackup rigs comprising:

a bowl housing comprising an inner aperture to receive a removably disposed seal and bearing assembly; and a seal and bearing assembly comprising:

a seal and bearing housing, a rotatable mandrel disposed within an inner aperture of the seal and bearing housing, an upper seal carrier attached to a top side of the seal and bearing housing comprising a dynamic sealing element that contacts the rotatable mandrel, a plurality of tapered-thrust bearings to facilitate rotation of the rotatable mandrel, wherein the plurality of tapered-thrust bearings comprise top tapered-thrust bearings indirectly mounted at a positive offset angle from a perpendicular line to a longitudinal axis of the rotating control device and bottom tapered-thrust bearings indirectly mounted at a negative offset angle from the perpendicular line to the longitudinal axis of the rotating control device, a preload spacer disposed between the top and bottom tapered-thrust bearings, and a lower seal carrier attached to a bottom side of the seal and bearing housing comprising a plurality of removable seal carrier trays, wherein a plurality of dynamic sealing elements that contact the rotatable mandrel are removably disposed within the plurality of removable seal carrier trays.

7. The rotating control device of claim 6, further comprising:

an intra-overshot-pipe assembly removably attached to a top distal end of the rotatable mandrel, the intra-overshot-pipe assembly comprising a second interference-fit sealing element, wherein the intra-overshot-pipe assembly is disposed within an overshot pipe disposed above the rotating control device.

8. The rotating control device of claim 6, further comprising:

a top flange comprising a top flange lumen attached to a top distal end of the bowl housing; and a bottom flange comprising a bottom flange lumen attached to a bottom distal end of the bowl housing.

9. The rotating control device of claim 6, further comprising a shroud to protect protruding portions of hydraulically-actuated fail-last-position latching assemblies.

10. The rotating control device of claim 6, wherein top tapered-thrust bearings are indirectly mounted at an offset angle in a range between 10 degrees and 40 degrees from the perpendicular line to the longitudinal axis of the rotating control device.

11. The rotating control device of claim 6, wherein bottom tapered-thrust bearings are indirectly mounted at an offset angle in a range between −10 degrees and −40 degrees from the perpendicular line to the longitudinal axis of the rotating control device.

12. The rotating control device of claim 6, wherein the back-to-back orientation of the top and bottom tapered-thrust bearings increases radial stability.

13. The rotating control device of claim 6, wherein a first interference-fit sealing element seals an annulus surrounding the drill pipe.

14. The rotating control device of claim 6, wherein a second interference-fit sealing element forms a redundant seal to the annulus surrounding the drill pipe.

15. The rotating control device of claim 6, wherein a first interference-fit sealing element, the rotatable mandrel, and a second interference-fit sealing element rotate with the drill pipe.

16. The rotating control device of claim 6, wherein a first interference-fit sealing element and a second interference-fit sealing element comprises natural rubber, nitrile butadiene rubber, hydrogenated nitrile butadiene rubber, polyurethane, elastomeric material, or combinations thereof.

17. The rotating control device of claim 6, wherein a first interference-fit sealing element comprises a first seal lumen having a first seal inner aperture slightly smaller than an outer diameter of the drill pipe and a second interference-fit sealing element comprises a second seal lumen having a second seal inner aperture slight smaller than the outer diameter of the drill pipe.

18. The rotating control device of claim 6, wherein an overshot pipe is bolted to a top flange of the bowl housing.

19. The rotating control device of claim 10, wherein the intra-overshot-pipe assembly disposed within the overshot pipe rotates with the mandrel.

20. The rotating control device of claim 6, wherein a bottom flange of the bowl housing is attached to an annular or blow-out preventer connection disposed below the rotating control device.

* * * * *